US011536443B2

(12) United States Patent
Ter-Hovhannisyan

(10) Patent No.: US 11,536,443 B2
(45) Date of Patent: Dec. 27, 2022

(54) HEAT DISSIPATING LED LIGHTING FIXTURE

(71) Applicant: Light Emitting Design, Inc., Burbank, CA (US)

(72) Inventor: Zorak Ter-Hovhannisyan, Burbank, CA (US)

(73) Assignee: Light Emitting Design, Inc., Burbank, CA (US)

( * ) Notice: Subject to any disclaimer, the term of this patent is extended or adjusted under 35 U.S.C. 154(b) by 0 days.

(21) Appl. No.: 16/705,000

(22) Filed: Dec. 5, 2019

(65) Prior Publication Data

US 2020/0182452 A1 Jun. 11, 2020

Related U.S. Application Data

(60) Provisional application No. 62/775,560, filed on Dec. 5, 2018.

(51) Int. Cl.

| | |
|---|---|
| ***F21V 29/74*** | (2015.01) |
| ***F21V 29/83*** | (2015.01) |
| ***F21V 15/01*** | (2006.01) |
| ***F21V 31/00*** | (2006.01) |
| ***F21S 4/28*** | (2016.01) |
| *F21Y 115/10* | (2016.01) |

(52) U.S. Cl.

CPC ..... *F21V 29/74* (2015.01); *F21S 4/28* (2016.01); *F21V 15/01* (2013.01); *F21V 29/83* (2015.01); *F21V 31/005* (2013.01); *F21Y 2115/10* (2016.08)

(58) Field of Classification Search

CPC ..... F21Y 2115/10; F21Y 2105/10; F21S 4/28; F21V 29/74; F21V 29/745; F21V 29/76; F21V 29/763; F21V 29/767; F21V 29/77; F21V 29/773; F21V 29/777; F21V 29/78; F21V 29/83

See application file for complete search history.

(56) References Cited

U.S. PATENT DOCUMENTS

| | | | | |
|---|---|---|---|---|
| 8,272,765 | B2 | 9/2012 | Ter-Hovhannisyan | |
| 8,757,842 | B2 | 6/2014 | Ter-Hovhannisyan | |
| 9,010,956 | B1 * | 4/2015 | Davis | F21V 29/77 362/147 |
| 9,383,084 | B2 | 7/2016 | Ter-Hovhannisyan | |
| 10,386,058 | B1 * | 8/2019 | Cattoni | F21S 8/061 |
| 2008/0080187 | A1 | 4/2008 | Purinton | |

(Continued)

OTHER PUBLICATIONS

International Search Report for the International Application No. PCT/US19164764 dated Feb. 25, 2020.

*Primary Examiner* — Robert J May

(74) *Attorney, Agent, or Firm* — Cohen IP Law Group, PC; Michael N. Cohen

(57) ABSTRACT

A heat dissipating light fixture includes one or more elongated rows of LEDs extending a length of a light engine, and forming an array having outer and inner perimeter edges. At least one light engine heat sink is conductively coupled to the light engine and disposed adjacent to the array of LEDs. A driver assembly includes a driver that supplies power to the light engine coupled to the light engine in spaced relation thereto, and a driver heat sink is conductively coupled to the driver and disposed relative to the at least one light engine heat sink so as to prevent conductive heat transfer therebetween.

23 Claims, 29 Drawing Sheets

(56) References Cited

U.S. PATENT DOCUMENTS

| | | | | |
|---|---|---|---|---|
| 2008/0151541 | A1 | 6/2008 | Heffington et al. | |
| 2010/0130142 | A1 | 5/2010 | Schubert | |
| 2011/0026249 | A1 | 2/2011 | Wylde et al. | |
| 2011/0309751 | A1 | 12/2011 | Ter-Hovhannisyan | |
| 2013/0083522 | A1* | 4/2013 | Bowers | F21V 7/005 362/235 |
| 2016/0363308 | A1 | 12/2016 | Shum | |
| 2017/0227207 | A1 | 8/2017 | Bendtsen et al. | |

* cited by examiner

HEAT DISSIPATING LED LIGHTING FIXTURE

RELATED APPLICATION

This application claims the benefit of U.S. Provisional Application No. 62/775,560, filed Dec. 5, 2018.

BACKGROUND OF THE INVENTION

The present invention relates generally to LED lighting fixtures. More specifically, the present invention relates to LED lighting fixtures in which a light engine and driver each have their own integrated heat sinks to provide heat dissipating characteristics.

Heat sinks are components or assemblies designed to transfer energy away from a device generating heat. Oftentimes, heat sinks make use of a fluid medium such as water or air to facilitate heat exchange to the surrounding environment. Some examples of heat sinks used as a means for heat transfer include refrigeration systems, air conditioning systems, radiators, etc. Other types of heat sinks are used to cool electric devices, such as circuit boards, computer chips, diodes, and other higher-powered optoelectronic devices such as lasers and light emitting diodes (LEDs).

Electronic devices typically have heat sinks that pass air over a heat dissipation surface directly coupled to the heat generation source. The heat dissipation area is designed to increase heat transfer away from the heat generating core, thereby cooling the electric device. Heat transfer occurs mainly by way of convection.

In computer chips, a highly conductive material having a fan thereon is typically mounted directly to the processor. The fan forces air over the conductive material to increase the rate of convection. Without the fan, convection would otherwise occur naturally because hotter air near the source would rise relative to denser, cooler air. For example, as a processor heats the surrounding air, the warmer and less-dense air rises away from the processor and is replaced by the denser, cooler air. In fact, the warmer air will continue to move away from the heat source until it reaches the ambient air temperature of the surrounding environment. The process continues as cooler air continually replaces upwardly rising warmer air. Fans force convection by blowing air across a heated surface. This naturally results in increased cooling as cooler air forcefully enters the heated space and warmer air is forced out. Natural convection forces may still be present, but they are typically negligible in such an embodiment.

Forced convection may remove more heat than natural convection, but forced convection carries several drawbacks. For instance, forced convection requires a device, such as a fan, to move the air. In small electronic packages or where it is desirable to minimize the amount of energy expended to cool the electronic components, forced convection may be undesirable. Moreover, reliance on the fans can be detrimental to the operation of the device should the fan become nonoperational. In some circumstances replacing a nonfunctioning fan could be a maintenance problem. Thus, to save time, energy and labor costs required to operate and maintain such devices, it is generally desirable to eliminate the fan from the heat sink, if possible.

For lighting applications, LEDs are particularly energy efficient and tend to have a long operating life. LEDs may be employed in many different basic lighting structures to replace conventional neon or fluorescent lighting. More specifically, LED lighting assemblies may be deployed as streetlights, automotive headlights or taillights, traffic and/or railroad signals, advertising signs, etc.

These assemblies are typically exposed to natural environmental conditions and may be exposed to high ambient operating temperatures—especially during the daytime, in warmer climates and in the summer. When coupled with the self-generated heat of the LEDs in the assembly, the resulting temperature within the assembly may affect LED performance. In fact, LED performance tends to substantially degrade at higher operating temperatures because LEDs have a negative temperature coefficient of light emission. That is, LED illumination decreases as the ambient temperature rises. For example, LED light intensity is halved at an ambient temperature of 80° Celsius ("C") compared to 25° C. This naturally shortens the lifespan of the LED and reduces light output. These adverse operating conditions can have safety implications depending on the application. Thus, the LED temperature should be kept low to maintain high illumination efficiency.

Heat sink design considerations, therefore, have become increasingly important as LEDs are used in more powerful lighting assemblies that produce more heat energy. Heat to be dissipated in conventional LED assemblies has reached a critical level such that more intricate heat dissipation designs are needed to better regulate the self-generated heat within the LED assembly. The increased heat within the assemblies is mainly caused by substantially increasing the device drive current or watts to achieve higher luminous output from the LEDs. Preferably, the internal temperature of the lamp assembly is maintained somewhat below the maximum operating temperature, so the electrical components therein maintain peak performance. It is advantageous to design an assembly with a mechanism that continually cools the chamber and the LEDs located therein. Accordingly, there is a constant need for improved thermal management solutions for LED-based lighting systems.

There exists, therefore, a significant need a heat dissipating light fixture having an improved heat sink system that improves the efficiency of dissipating heat away from a heat generating device. Moreover, there exists a significant need for an improved heat dissipating lighting fixture wherein the driver and its sensitive electronic components is thermally removed or even isolated from the heat generated by the light engine portion of the lighting fixture. The present invention fulfills these needs and provides further related advantages.

SUMMARY OF THE INVENTION

The present invention is directed to an improved heat dissipating lighting fixture. In accordance with the present invention, the light engine and the driver assembly each have their own heat sinks, and the driver assembly is removed or isolated from the light engine so as to prevent conductive heat transfer therebetween. This arrangement has been found to enable the lighting fixture of the present invention to be used in greater wattage and ambient heat applications, while preserving the useful life of the electronic components of the driver.

The lighting fixture of the present invention generally comprises a light engine having a plurality of light emitting diodes formed in at least one elongated row, which extends substantially a length of the light engine. The light emitting diodes form an array having an outer perimeter edge and an inner perimeter edge. The light emitting diode array may comprise a plurality of generally parallel rows of light emitting diodes. The light engine may be generally ring-shaped.

At least one light engine heat sink is conductively coupled to the light engine, and disposed adjacent to the outer perimeter edge and the inner perimeter edge of the light emitting diode array. Typically, the at least one lighting engine heat sink comprises spaced apart cooling fins and vent apertures. The at least one light engine heat sink may comprise spaced apart generally parallel rows of cooling fins, the light emitting diode array being disposed between the rows of cooling fins.

The at least one light engine heat sink may comprise an upper light engine heat sink and a lower light engine heat sink disposed relative to one another such that the air vents of the upper light engine heat sink are each aligned with an at least one cooling fin of the lower light engine heat sink. The fins and vent apertures of the upper and lower light engine heat sinks are disposed over the outer perimeter edge and inner perimeter edge of the light emitting diode array. The upper and lower light engine heat sinks may be attached to one another so as to extend over and at least partially surround the light emitting diode array.

A driver assembly comprises a driver for supplying power to the light engine coupled to the light engine in spaced relation thereto. The driver assembly may be substantially surrounded by the light engine, in spaced relation thereto. A driver heat sink is conductively coupled to the driver. The driver heat sink is preferably disposed relative to the at least one light engine heat sink so as to prevent conductive heat transfer therebetween. The driver assembly may be substantially disposed to ambient air.

A junction box may be formed adjacent to the driver. A cover of the junction box may be dome-shaped. Preferably, the light engine, driver assembly and junction box are hermetically sealed.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
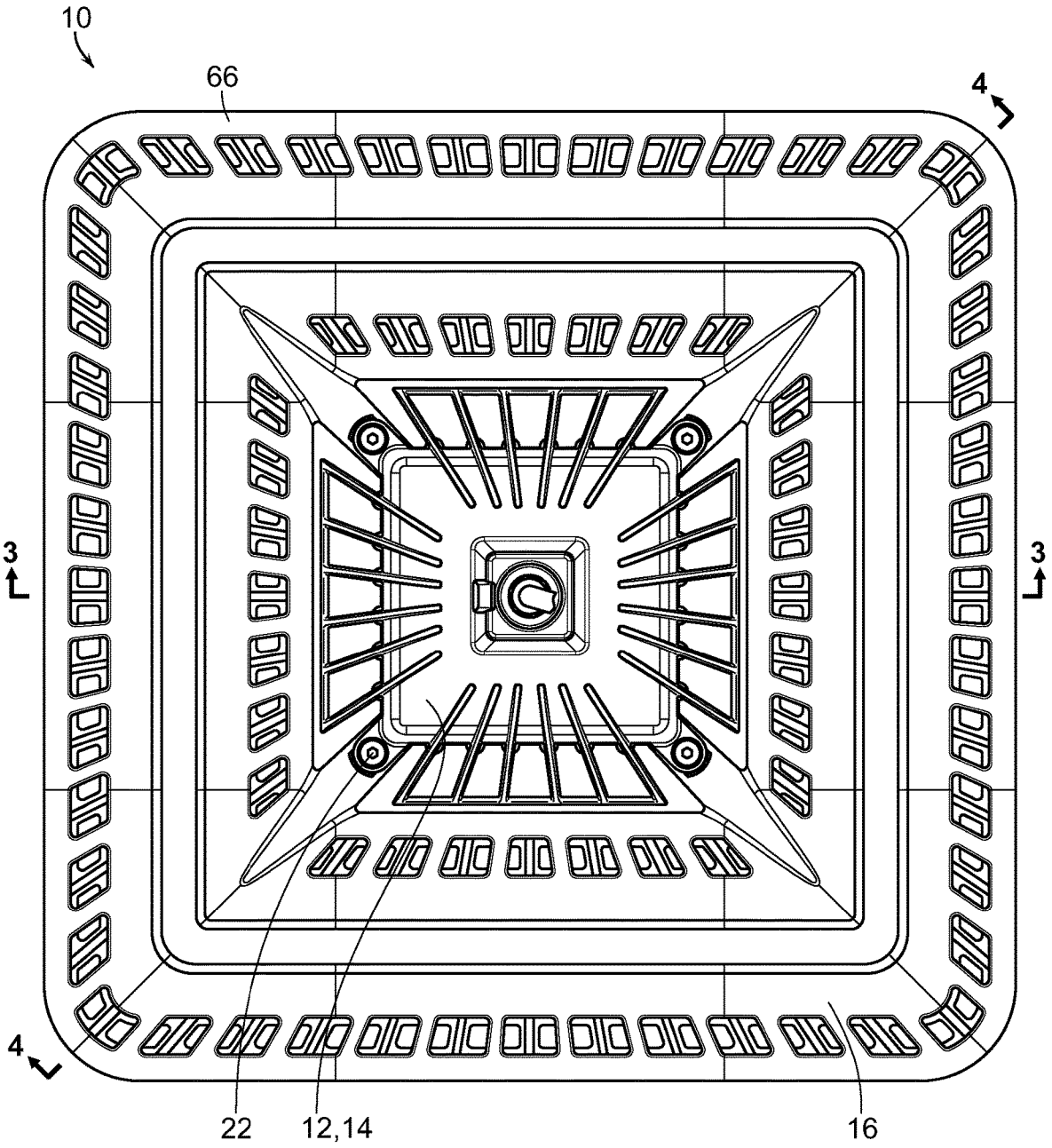
FIG. 1 is a top plan view of a heat dissipating LED lighting fixture embodying the present invention.

As shown in the drawings for purposes of illustration, the present invention is directed to a heat dissipating light fixture generally referred to by the reference number 10. The lighting fixture 10, as illustrated and described herein, provides an improved arrangement and heat sink system and can be utilized in many applications, such as high wattage applications, industrial applications having relatively high ambient temperatures, and the like. This is due, at least in part, to the improved thermal isolation between a driver of the lighting device and a light engine of the lighting device, as well as efficient cooling of the components of the lighting fixture 10.

With reference to FIG. 1, a top plan view of the lighting fixture 10 is shown. In one embodiment, a driver assembly 11, comprising a driver 12 and coupled driver heat sink 14, are substantially surrounded by, in spaced relation, a light engine 16 and corresponding light engine heat sinks. In the illustrated embodiment, the light engine is generally ring-shaped, which can be circular, square, multifaceted, or any other substantially encircling design. The driver assembly 11 is conveniently disposed within a central area defined by the encircling light engine, so as to be in spaced relation thereto so that the driver assembly 11 is substantially exposed to ambient air and to a large extent physically separate from the light engine 16 and accompanying heat sinks. While the driver assembly 11, in accordance with the present invention, is physically separated and independent from the light engine 16, so as to be thermally isolated therefrom, it will be understood that the driver assembly 11 could be placed outside of the light engine, adjacent to the light engine, or the like and still accomplish the purposes of the invention.

The light engine 16, with its array of plurality of light emitting diodes (LEDs) generates the vast majority of the heat generated by the lighting fixture 10. The driver 12 and its electrical components, such as power supply, circuits and other similar components and devices that operate the lighting fixture 10, generate a much smaller amount of heat when in operation. However, the electronics and components of the driver 12 are susceptible to heat which can shorten the components' life span and/or damage the components of the driver 12.

Thus, the present invention separates the driver 12 from the light engine 16 so as to thermally remove or even isolate the driver 12 from the light engine 16, to the greatest extent possible to reduce or even eliminate the conductive heat transfer therebetween and thus prolong the operation life of the components of the driver 12 and enable the driver 12 to be used in higher wattage, and thus higher temperature, lighting fixtures. For example, the lighting fixture 10 of the present invention could operate at 500 watts, 700 watts, or even greater due to the arrangements and use of heat sinks illustrated and described herein, whereas the prior art is either not able to be used in connection with such high wattages and resultant heat or must periodically reduce the wattage and/or selectively power off LEDs to reduce the generated heat, but which will also result in lowering the wattage or lumens generated by the lighting device. The present invention overcomes these shortcomings.

Figure 2:
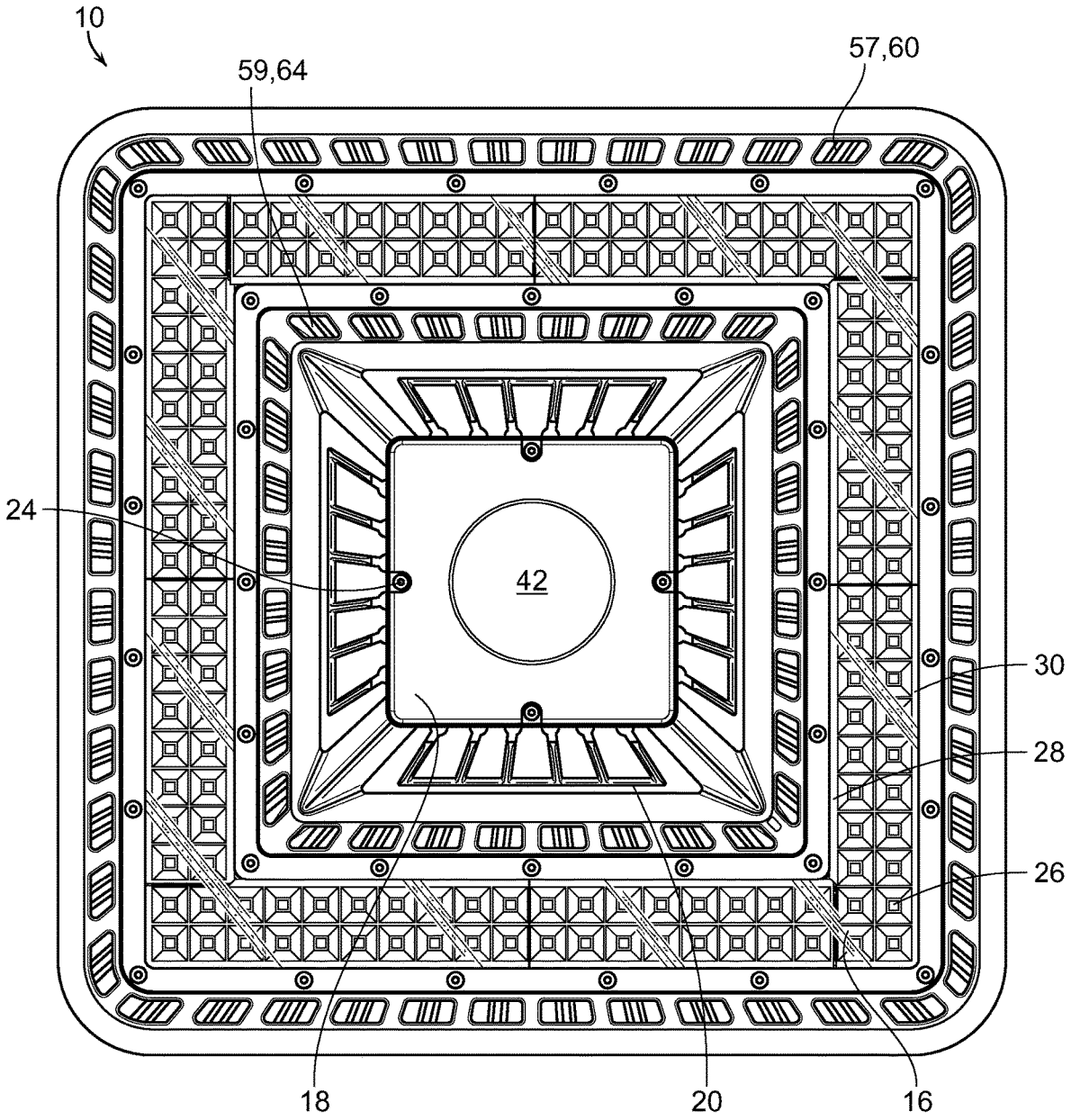
FIG. 2 is a bottom plan view of the heat dissipating lighting fixture of FIG. 1.

With reference now to FIG. 2, a bottom plan view of the illustrative lighting fixture 10 is shown. In FIG. 2, a junction box 18 can be seen which is disposed below the driver 12. The driver heat sink 14 includes spaced apart heat fins 20, extending from the top of the driver assembly 11, as illustrated in FIG. 1. An additional benefit of separating the driver 12 from the light engine is the ability to replace the driver assembly 11, if needed, very easily by simply removing a few attachment points, such as the illustrated four screws 22 which provide connection points between the driver assembly 11 and the surrounding light engine assembly. As illustrated in FIG. 2, the interior of the junction box 18 can be accessed by removing screws 24 from connection points 25 of the light engine assembly to remove a cover of the junction box and access the electrical wires therein, and any necessary circuitry that might be part of the junction box. This is another advantage of the arrangement of the present invention.

With continuing reference to FIG. 2, a light engine 16 is illustrated which shows an overlying lens or cover, optical reflective elements, and an array of LEDs and related circuitry and connections. As shown, there is at least one elongated row of LEDs 26 extending substantially a length of the light engine 16. The LEDs 26 may be formed in a plurality of generally parallel rows, such as the illustrated two rows of LEDs in FIG. 2.

One or more light engine heat sinks are disposed at least adjacent to an inner perimeter 28 and an outer perimeter 30 of the LED array 26 so as to effectively transfer heat away from the LED array in a balanced manner. Preferably, as will be more fully described and shown herein, the one or more light engine heat sinks extend over and at least partially surround the LED array 26.

Figure 3:
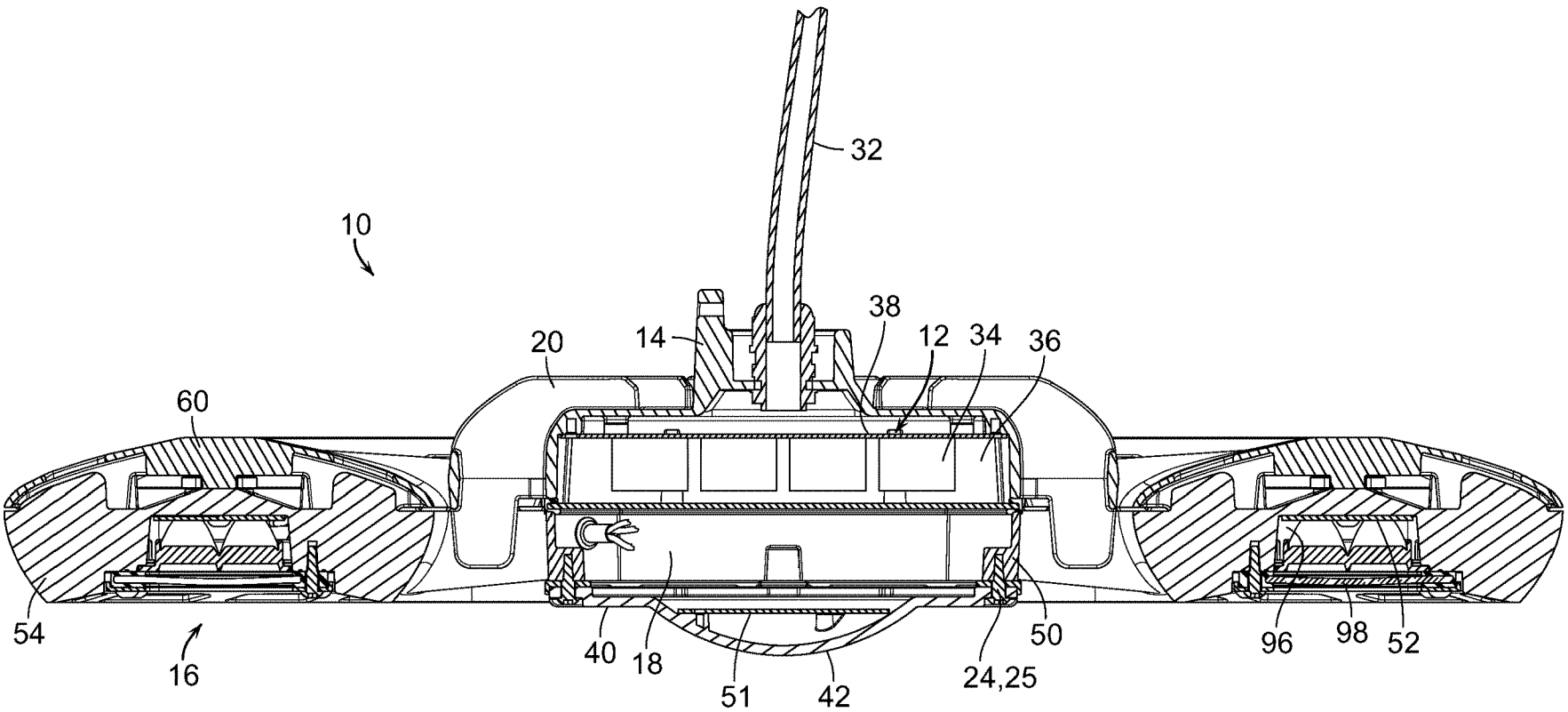
FIG. 3 is a cross-sectional view taken along line 3-3 of FIG. 1.
Figure 4:
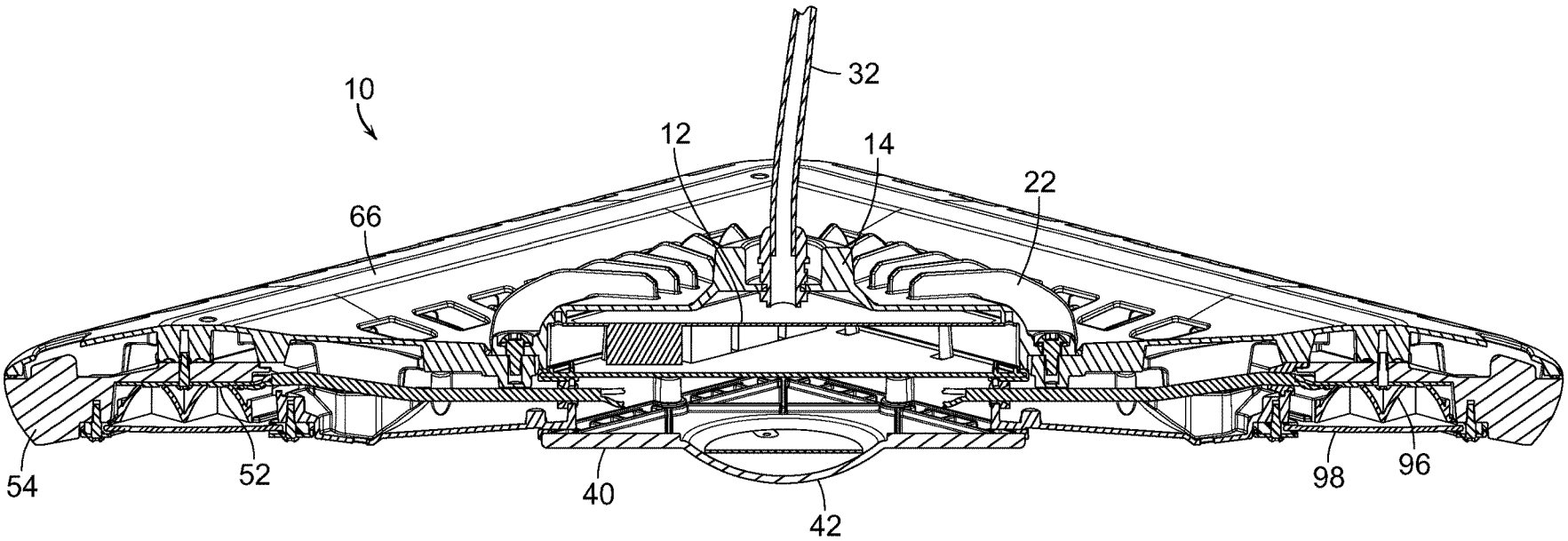
FIG. 4 is a cross-sectional view of the heat dissipating lighting fixture, taken generally along line 4-4 of FIG. 1.
Figure 5:
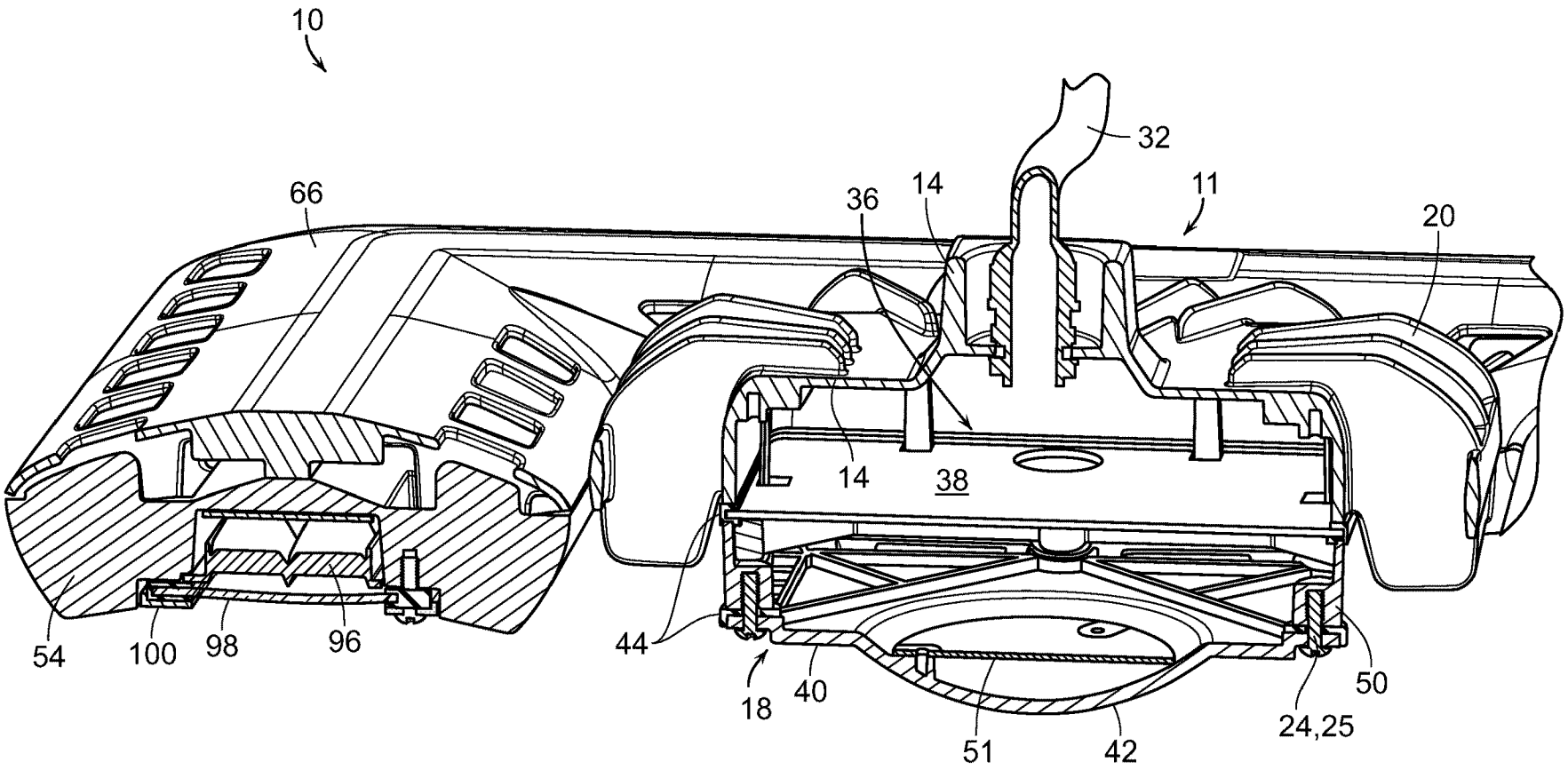
FIG. 5 is an enlarged cross-sectional view of a portion of the heat dissipating light fixture of the invention.

With reference now to FIGS. 3-5, cross-sectional views of the lighting fixture 10, in a fully assembled state, are shown. A power input wire or cable 32 is operably coupled and extended through the driver heat sink 14 and to the power supply and components within the driver 12. The input power may be alternating current, and one of the functions of the components of the driver 12 in such case is to convert the alternating current to direct current for use by the LEDs of the light engine. The internal electrical components 34 are disposed on a PCB 33 and within a cavity 36 formed by the driver heat sink 14. Typically, the cavity 36 is potted with appropriate thermal material which will serve to protect the electrical components and provide heat transfer therefrom to the driver heat sink 14, which has cooling fins 20 extending upwardly therefrom. The driver heat sink 14 is comprised of an appropriate thermally conductive material, such as aluminum, so as to transfer heat generated by the components 34 of the driver 12 which are transferred to the heat sink 14 and then to the ambient air passing over and substantially surrounding the driver heat sink 14. The fins 20, as illustrated, are preferably spaced apart from one another, such that ambient air can flow over each of the fins 20. The fins 20 extend from the conductive mount of the driver heat sink 14, which draws heat away from the electrical components 34 and 46 of the driver 12. It will be seen from the various drawings, however, that not only the driver 12 but also the driver heat sink 14, and its cooling fins 20, are physically separated from the surrounding light engine and accompanying heat sinks to the greatest extent possible so that ambient air substantially surrounds the driver assembly 11 so that it does not directly conduct or transfer heat between it and the one or more heat sinks of the light engine, such as by physical contact therewith or the like.

As can be seen in FIGS. 3-5, the junction box 18 is disposed below the driver 12. The junction box 18 may share the exposed lower wall 38 of the driver 12. Alternatively, an upper wall of the junction box 18 may be abutted adjacent to or even against the lower driver wall 38. Thus, the junction box 18 and the driver 12 are disposed adjacent to one another, which is convenient for the extension of electrical wires from the driver 12, through the junction box 18, and to the light engine. However, the junction box 18 is preferably separate from the driver 12 such that the contents thereof can be accessed without having to access the driver 12, as is the case with many prior art arrangements.

It will be understood that the driver assembly 11 is hermetically sealed against the environment, such as dust and moisture and the like, by seals 44 extending at connection points of its wall 38, so as to prevent dust, water and the like from entering therein. Similarly, the junction box 18, is also preferably sealed against water, dust, and other environmental intrusions, such as by a gasket 44 extending between its cover 40 and its housing, or the wall 50 of the light engine lower heat sink, which extends downwardly to define at least a portion of the junction box 18.

With continuing reference to FIGS. 3-5, the cover 42 has at least a portion, such as a central portion thereof, which is generally dome-shaped 42. The junction box 18 may house electronics, such as wireless receivers, transmitters, transceivers, sensors, cameras or the like which may be mounted on or coupled to PCB 51. It has been found that providing a dome-shaped 42 cover facilitates the transmission and reception of wireless signals, up to 180°, through the cover 40 and to the sensors, transceivers, and other electrical components which send and receive such wireless signals inside the junction box 18. Provision of the detachable cover 40 enables access to the junction box 18 itself, in a quick and simple manner, without having to access the driver 12, renders repair, replacement, or the like of such cameras, wireless electronics, sensors, or even wire connections within the junction box 18 much easier.

Figure 6:
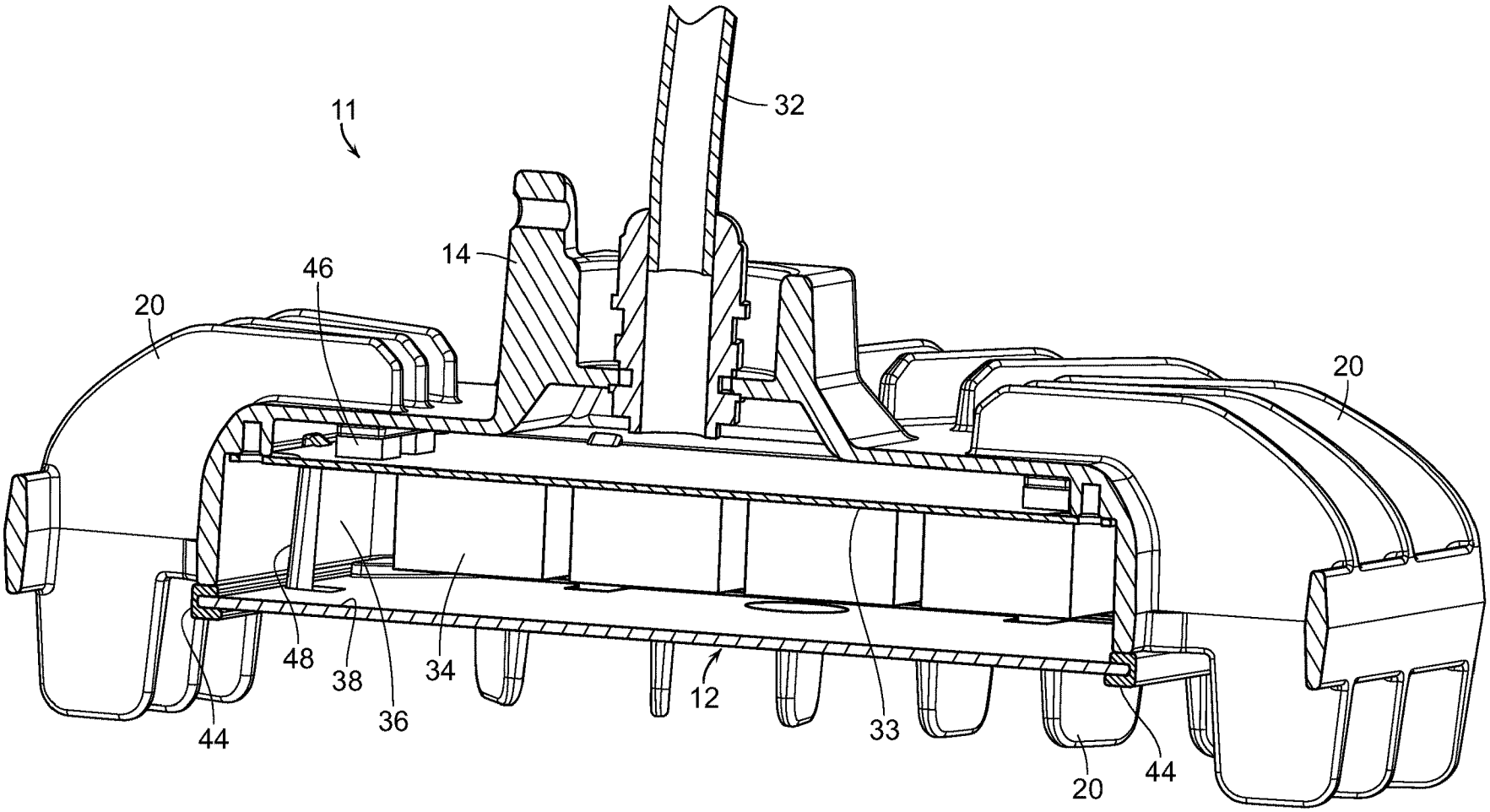
FIG. 6 is an enlarged cross-sectional and perspective view of a driver assembly of the present invention.

With reference to FIG. 6, an enlarged partially sectioned perspective view of the driver assembly 11 is illustrated. It will be seen that the lower wall 38 extends into seal 44, which provides a hermetic seal and prevents water or other environmental intrusion into the interior of the driver 12. Some electrical components 46 may extend from the PCB 33 into direct contact with the driver heat sink 14 for effectively transferring heat from these components 46 and driver 12 to the driver heat sink 14. The lower wall 38 may be snap-fit into place, such as by using clips 48, which render the attachment quick and easy. Such snap-fit clips 48, for example, could be used to remove the lower wall 38 so as to access the electronic components 34 therein. Typically, however, the components of the driver 12 are potted with a thermal material, such as silicone.

Figure 7:
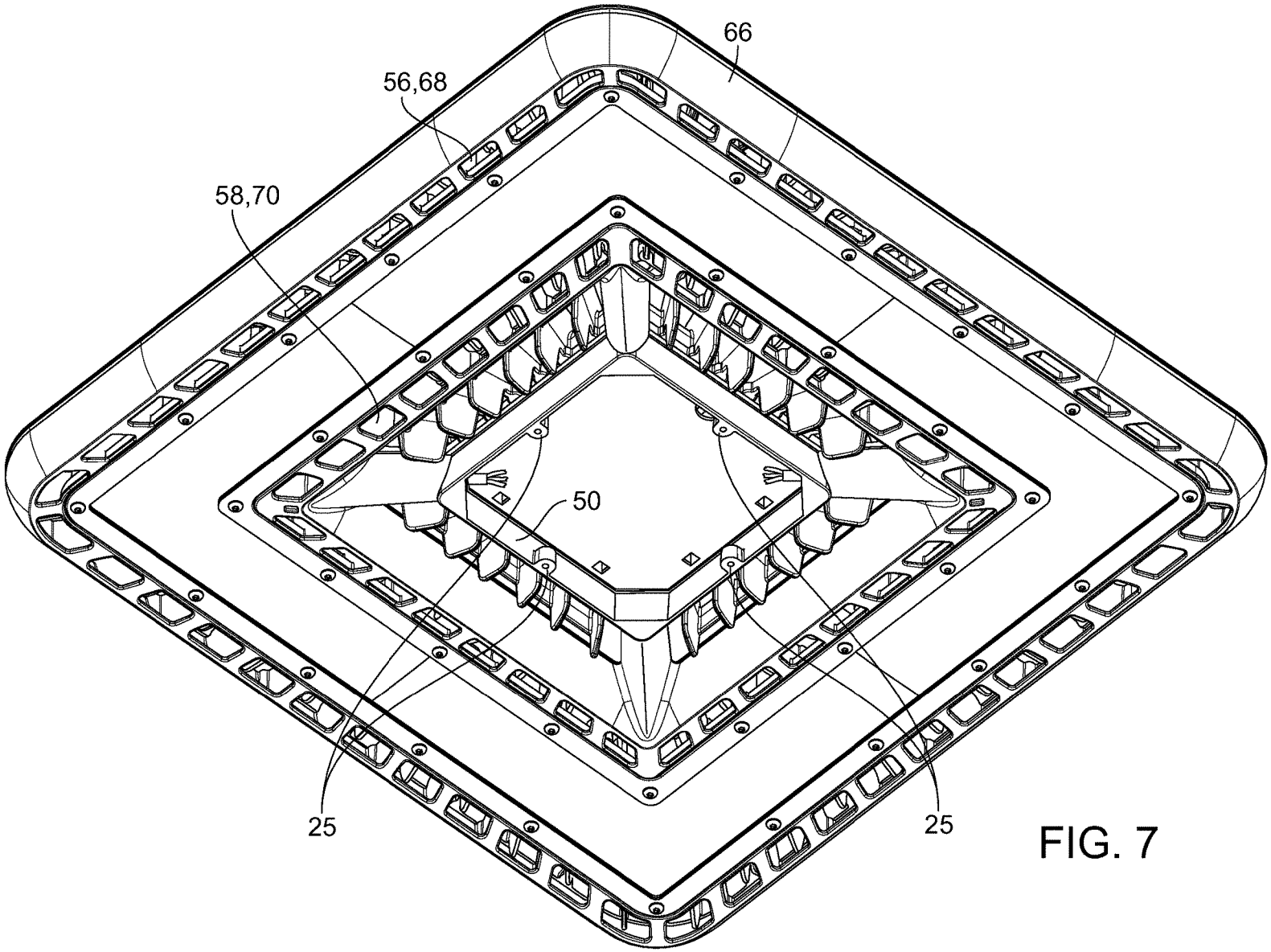
FIG. 7 is a bottom perspective view of a light engine and attached heat sinks used in accordance with the heat dissipating light fixture of the present invention.

With reference now to FIG. 7, a bottom perspective view of the light engine, with the one or more light engine heat sinks coupled thereto, is shown. In this drawing, for illustration purposes, the driver assembly 11 is not installed in the central cavity thereof. An overlapping arrangement of heat sink fins and cavities of the light engine heat sinks, as will be more fully explained herein, is also shown.

Figure 8:
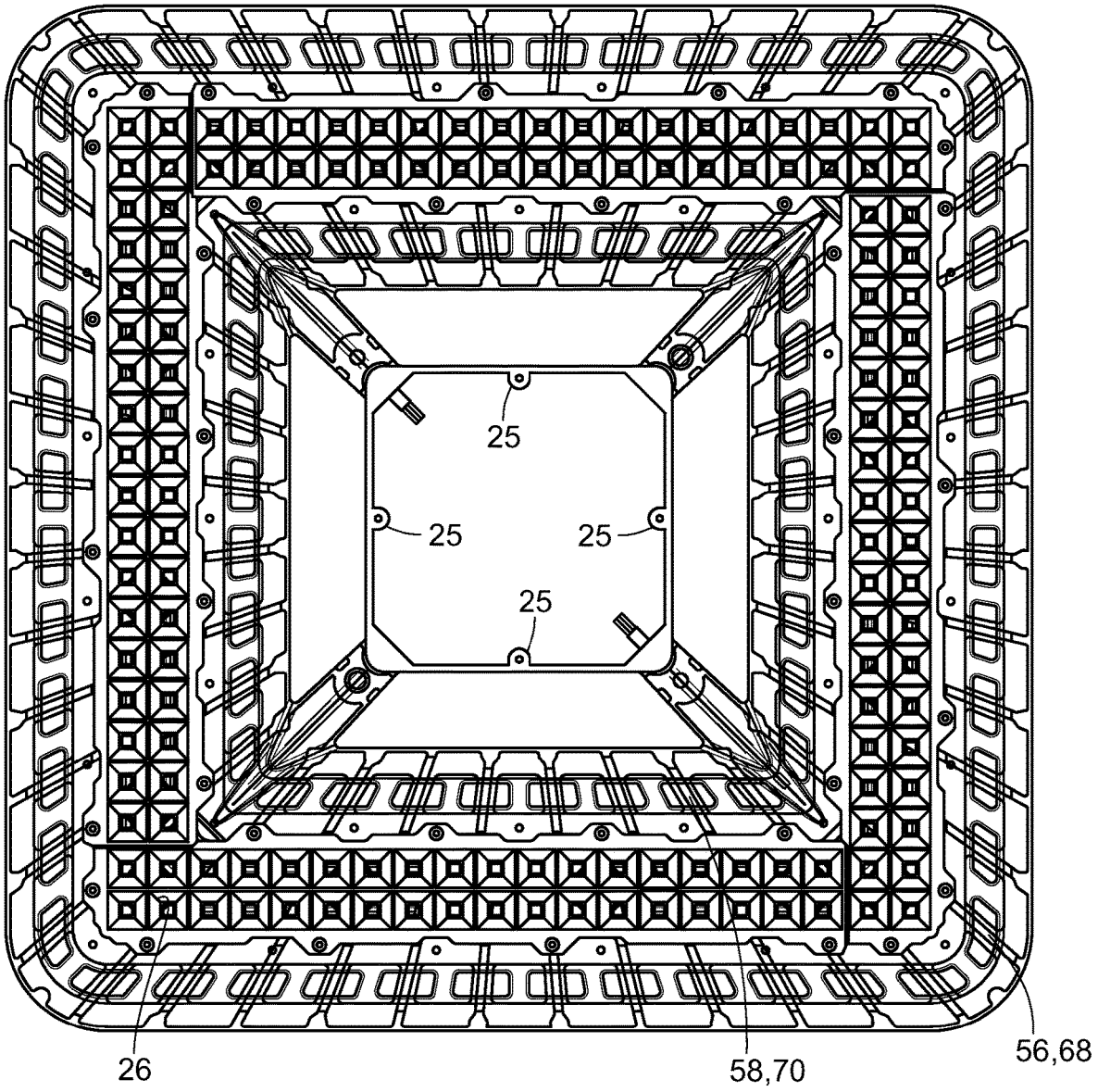
FIG. 8 is a bottom plan view of the light engine and heat sinks.
Figure 9:
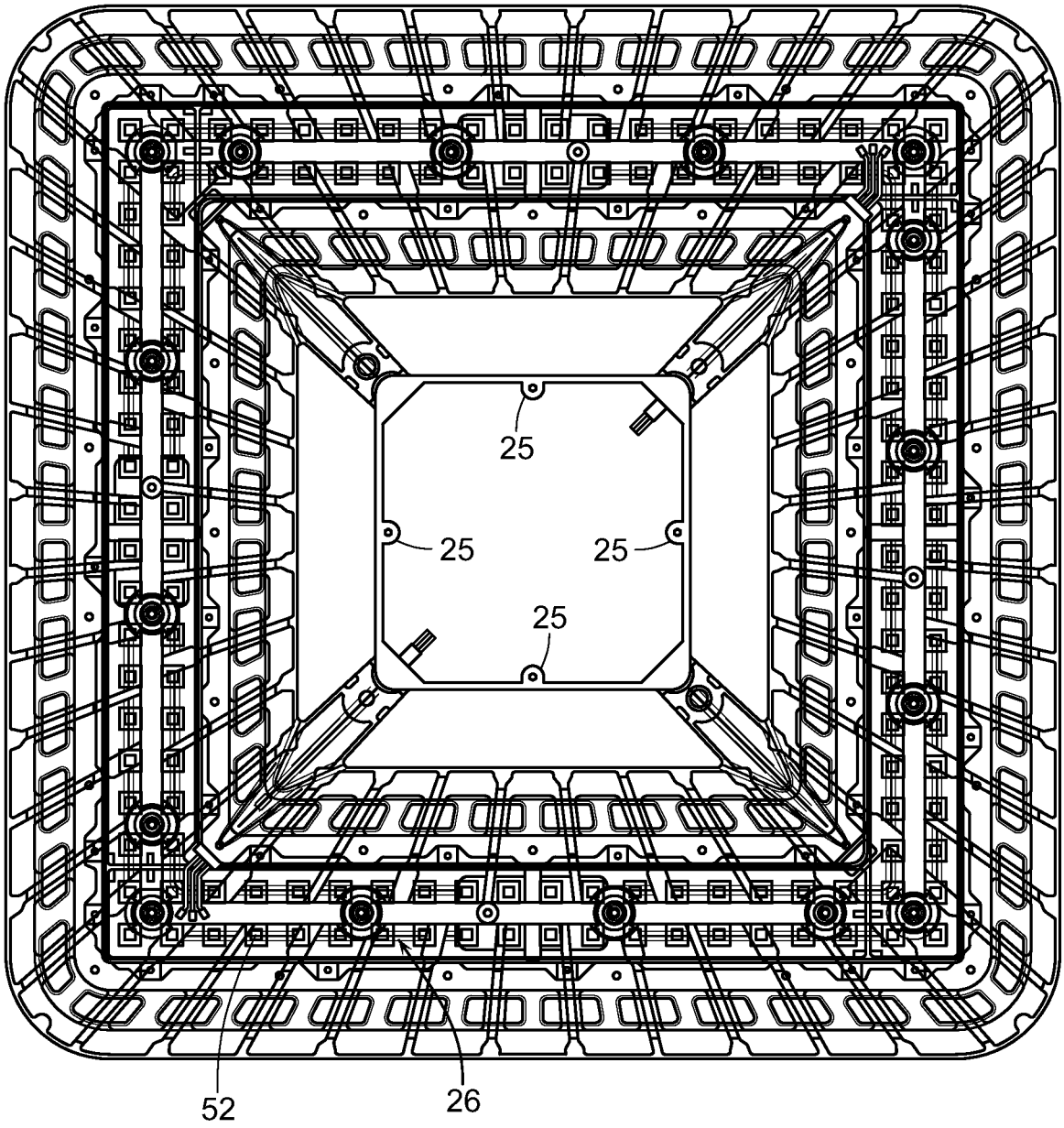
FIG. 9 is a bottom plan view of the light engine and heat sinks without the optical reflector or lens cover.

FIG. 8 is a bottom plan view of the assembly of FIG. 8. Once again, the driver assembly 11 and junction box 18 are not installed or shown. The LED array 26 is shown surrounded by heat sinks. FIG. 8 illustrates the fully assembled light engine having the cover lens and optical reflectors, whereas the bottom plan views of FIGS. 9 and 10 these are removed so as to show the individual LEDs 52 of the LED array 26. In the illustrated embodiment, two generally parallel rows of co-linear LEDs 52 substantially extend around the circumference of the light engine, which has a generally ring-shape. It will be understood, however, that there could be as few as one single row of LEDs, or several rows of LEDs. The LED array 26 will define an outer perimeter 30 and an inner perimeter 28.

Figure 20:
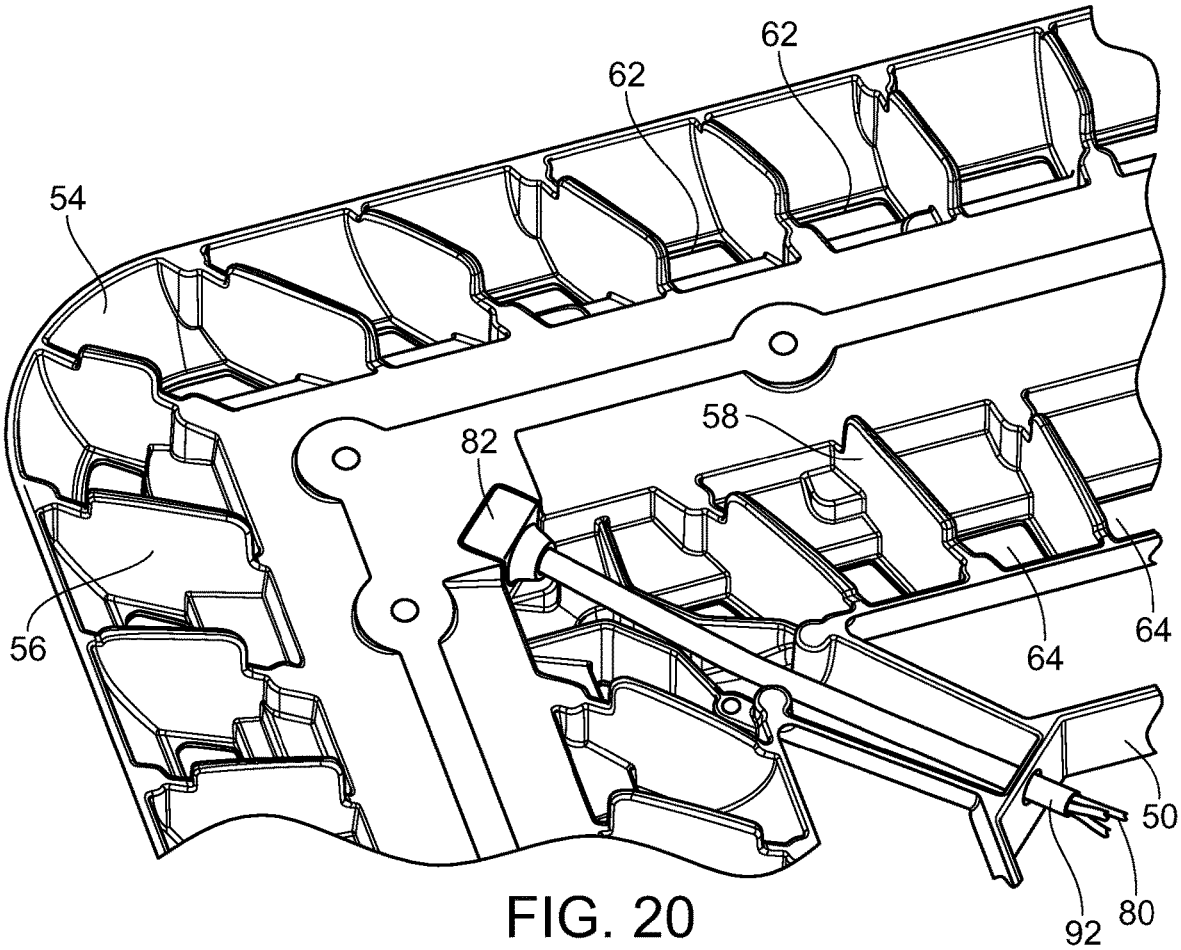
FIG. 20 is a partial perspective view of a heat sink having power wires extending therethrough.

In the various figures, such as FIG. 20, a lower heat sink 54 is illustrated. It will be seen that the heat sink 54 has spaced apart generally parallel rows 56 and 58 of cooling fins extending upwardly from a thermally conductive base 60 of the lower heat sink 54. The rows of heat fins 56 and 58 are shown concentric to each other. The outer row 56 of spaced apart heat fins 56 are disposed substantially adjacent to the outer perimeter of the LED array 26, whereas the inner row 58 of heat fins extend across and are disposed adjacent to the inner perimeter edge of the LED array. That is, the light engine and accompanying LED array 26 is disposed relative to the lower heat sink 54 such that the LED array is generally disposed below and between the outer and inner rows of heat fins 56 and 58 of the heat sink 54, as described above. Thus, as heat emanates from the LEDs, typically rising upwardly, it is conducted through the heat sink 54, such as the base of the heat sink 60, and through the rows of heat fins 56 and 58, which are spaced apart from one another so as to be exposed to ambient air, which will draw away heat from the rows of heat fins 56 and 58 and into the ambient air.

It will also be seen that there are vent apertures 62 formed around an outer perimeter portion of the heat sink 54, such as between the spaced apart heat fins 56 as well as a similar arrangement of vent apertures 64 formed on an inner perimeter portion of the heat sink 54, such as between the inner row of spaced apart heat fins 58. Preferably, as illustrated, the fins and vents are in alternating arrangement. The vent apertures 62 and 64 enable ambient air to flow through the heat sink 54 and over the heat fins 56 and 58.

Figure 11:
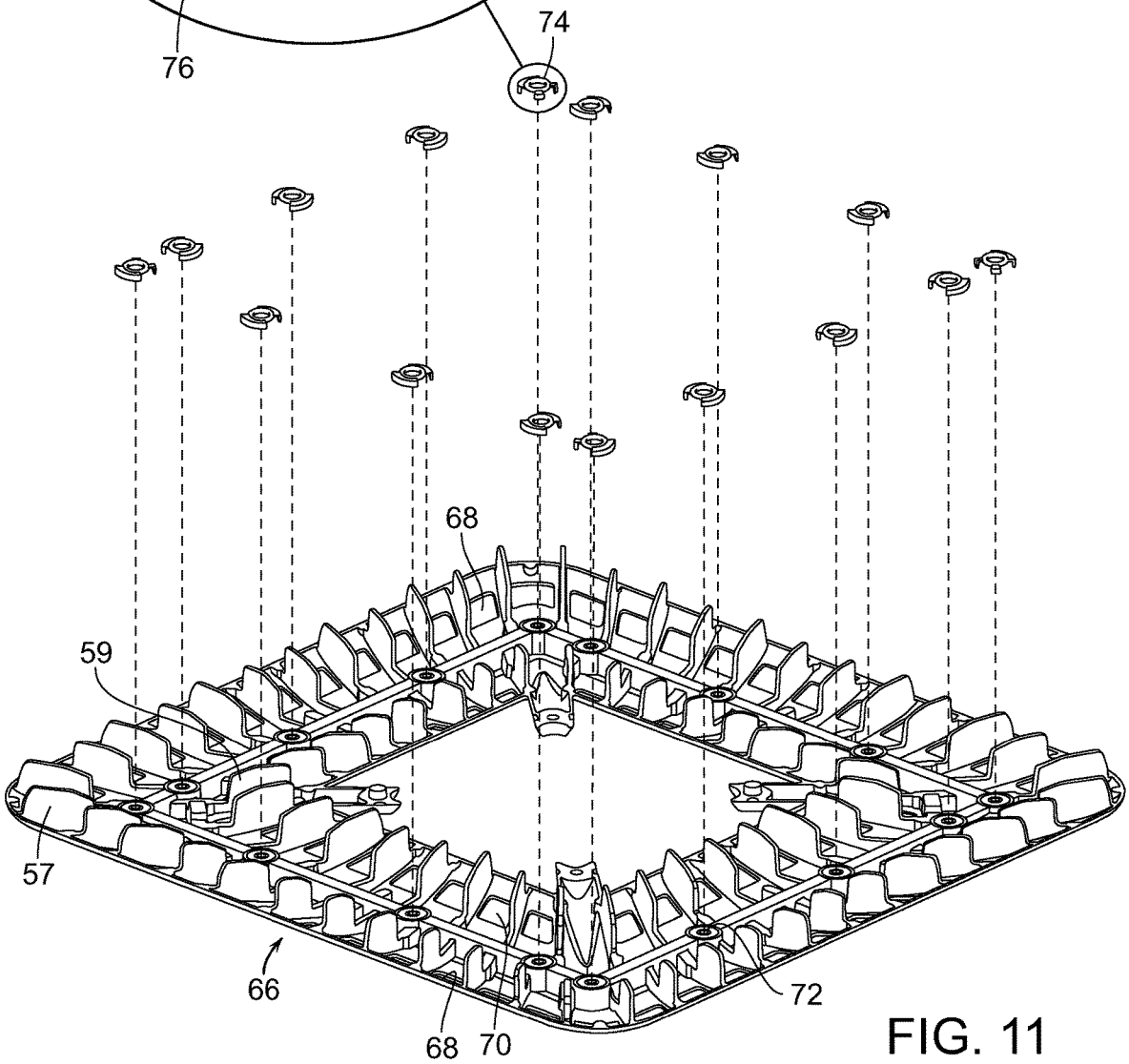
FIG. 11 is a top perspective view of an upper light engine heat sink.
Figure 13:
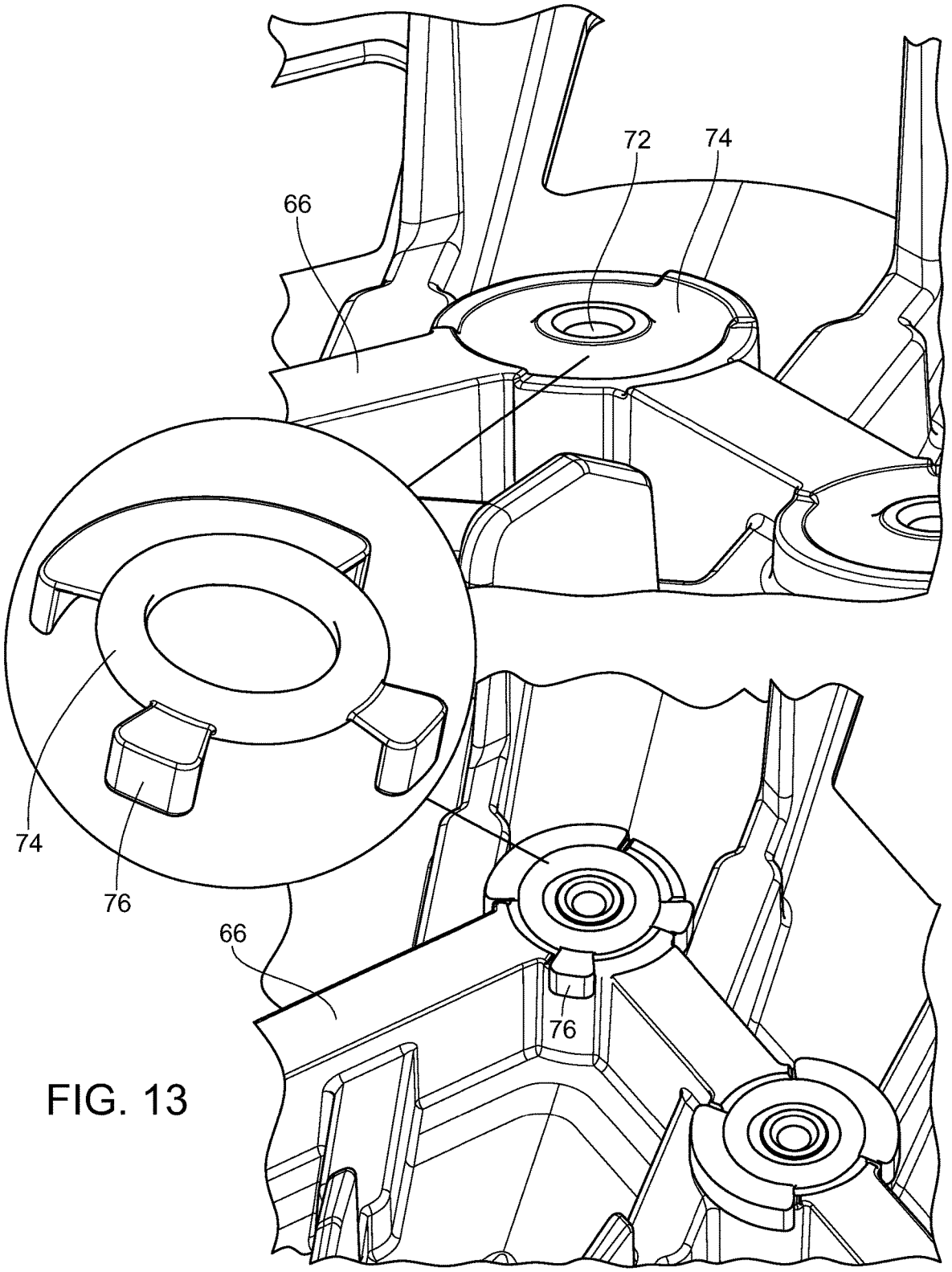
FIG. 13 are partial perspective views illustrating placement of the hermetic sealing O-rings of FIG. 12, in accordance with the present invention.
Figure 14:
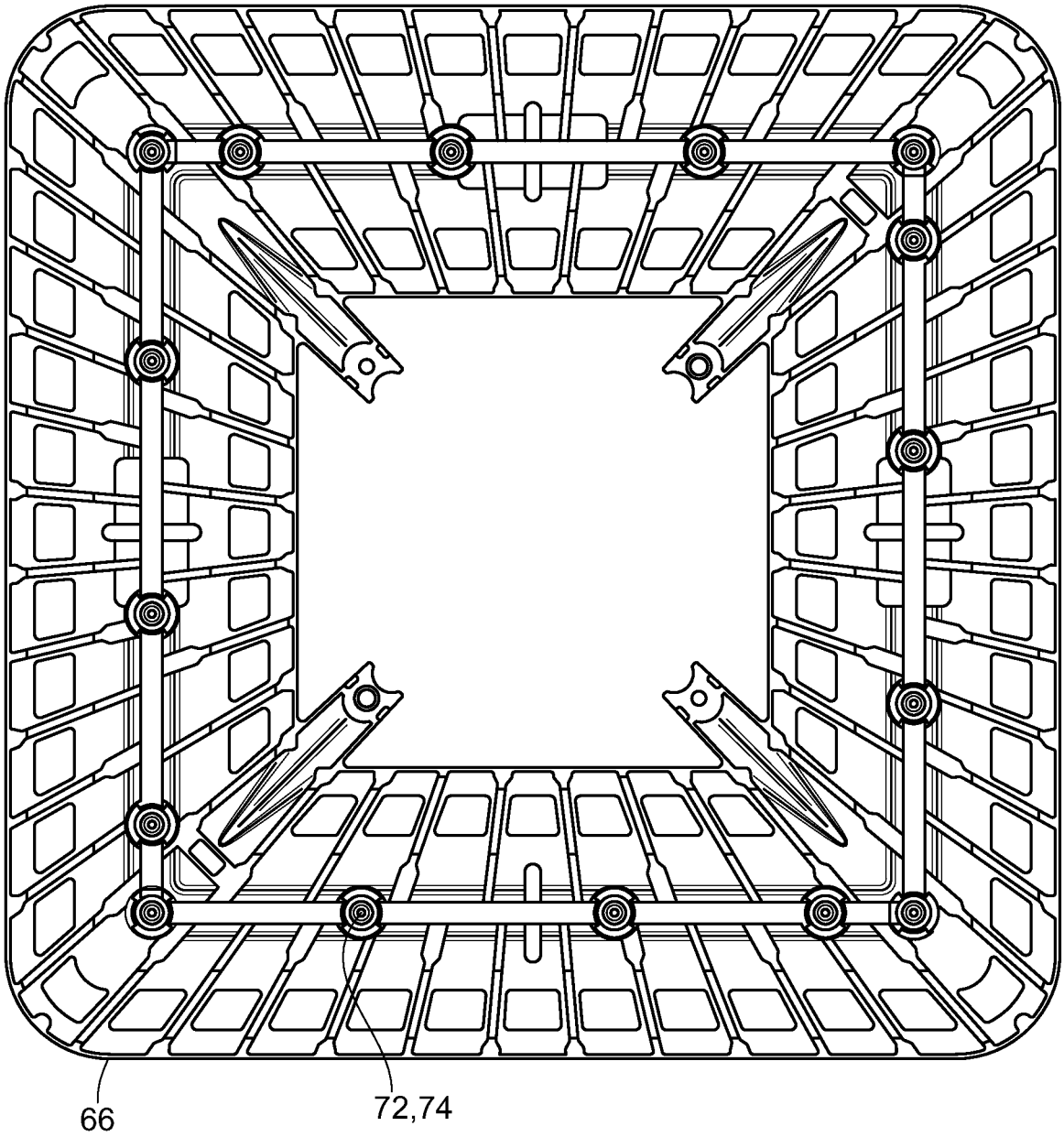
FIG. 14 is a view illustrating placement of the O-rings on the heat sink.

With reference now to FIG. 11, the upper or outer heat sink 66 has spaced apart outer apertures 68 defining air vents and a series of inner spaced apart apertures 70 defining air vents. These air vents 68 and 70 are formed such that one or more cooling fins 56 or 58 of the lower heat sink 54 will be aligned therewith when the lower heat sink 54 and the upper heat sink 66 are connected to each other or the light engine. The upper heat sink 66 also includes spaced apart rows of, as illustrated concentric, cooling fins 57 and 59 which will be generally aligned with the vent apertures 62 and 64 of the lower heat sink 54. It will be appreciated that the lower and upper heat sinks 54 and 66 are nearly mirror images of each other. In this manner, as ambient air is drawn and passes through the various vents 62, 64, 68 and 70, the offset nature of the vents to the cooling fins of the heat sinks 54 and 66 will result in air passing over the cooling fins as the air passes through the vents 62, 64, 68 and 70, drawing as much heat as possible from the heat sinks 54 and 66 as the air passes therethrough. Another way to explain this is that the cooling fins and the vent apertures of the respective heat sinks 54 and 66 are offset from one another such that cooling fins are generally aligned with vent apertures of the opposing heat sink. The fins 57 and 59 of the upper heat sink 66 extend downwardly on either side of the LED array 26 when the clam-shaped heat sinks 54 and 66 are attached to one another and the light engine.

Figure 12:
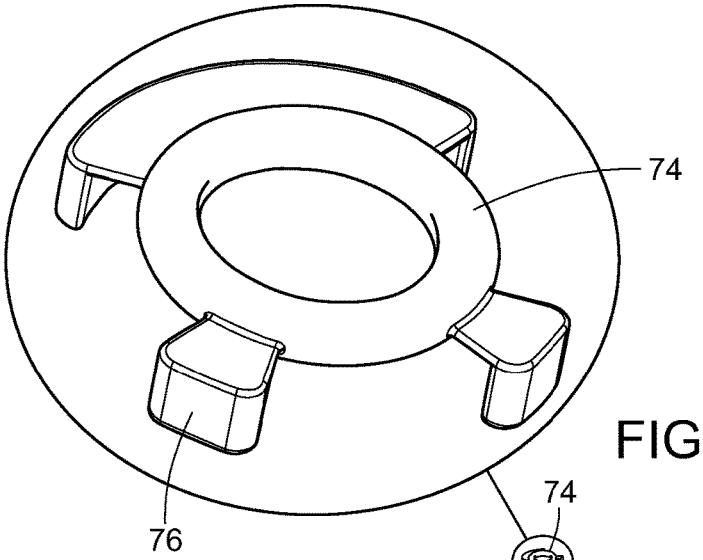
FIG. 12 is an enlarged perspective view of an O-ring for providing hermetic sealing between heat sinks.

With reference now to FIGS. 11-14, apertures, such as internally threaded apertures 72 are formed through the heat sink 66 for connection of the heat sink 66 to the light engine, which contains the light emitting diode array. O-ring gaskets 74, such as that illustrated in FIG. 12, are configured to encircle the aperture 72 and legs 76 of the gaskets 74 can be snap-fit over the surrounding area so as to hold the O-ring gasket 74 in place. The O-ring gaskets 74 provide a hermetic seal between the connection of the heat sink 66 and the light engine, so as to prevent dust, water or other environmental factors from entering within and adversely impacting the electronic components of the light engine.

Figure 22:
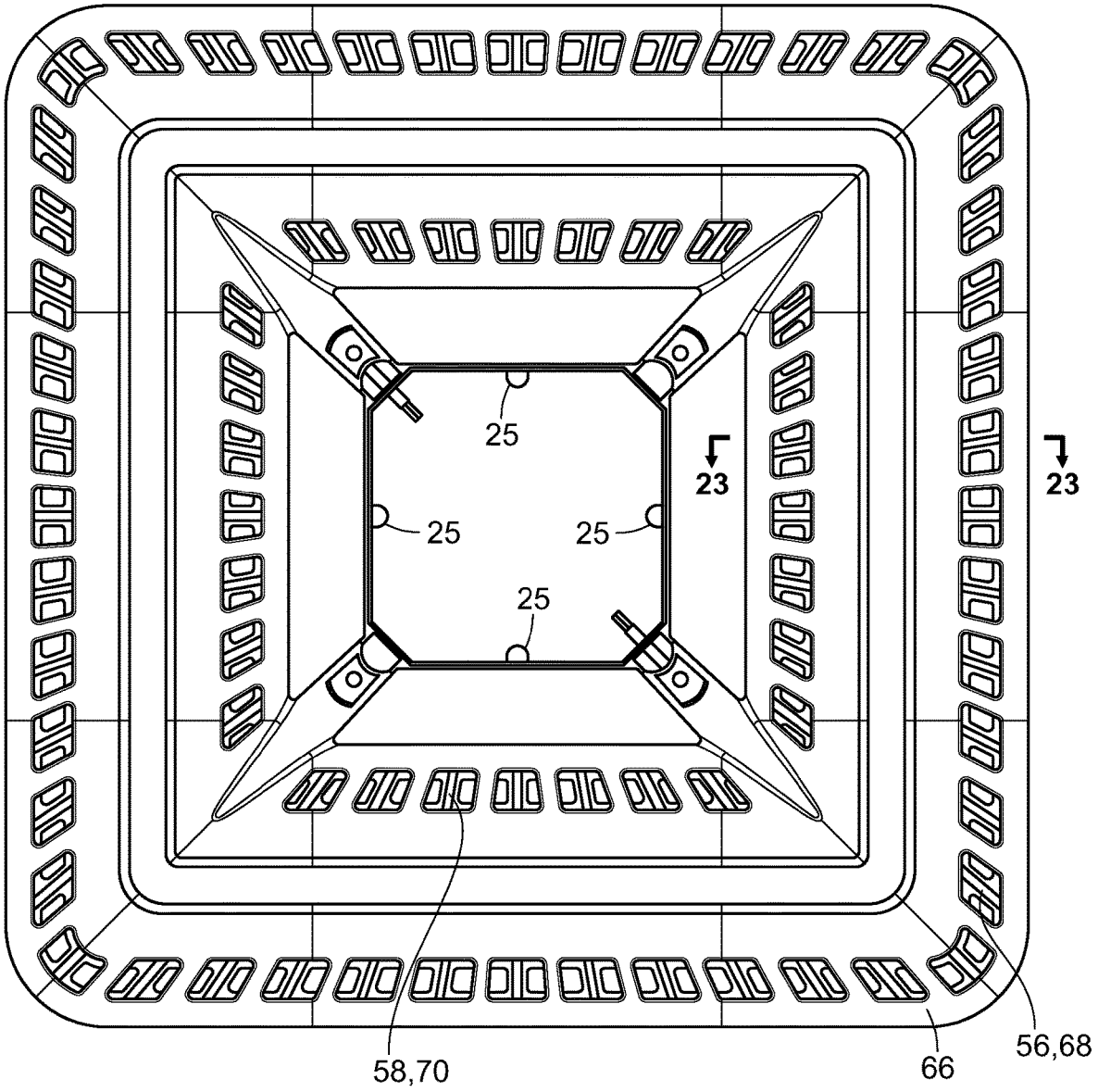
FIG. 22 is a top plan view of the light engine and heat sinks embodying the present invention.
Figure 23:
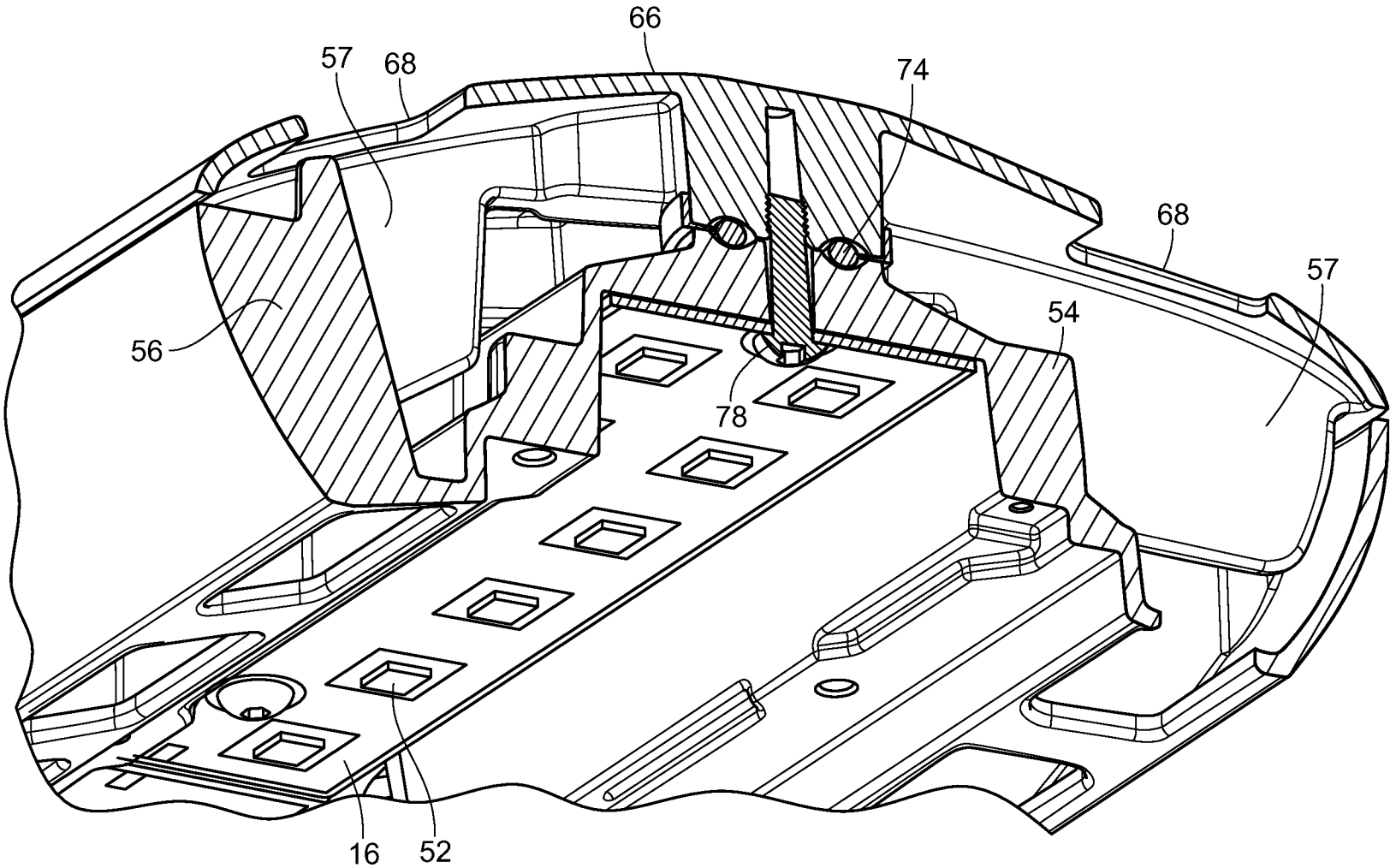
FIG. 23 is a perspective and sectional view taken generally along line 23-23 of FIG. 22 and illustrating a portion of the light engine disposed within the heat sinks.

With reference now to FIGS. 22 and 23, FIG. 23 is a partially sectioned perspective view taken generally along line 23-23 of FIG. 22, illustrating the interconnection of the light engine 16 supporting the light emitting diodes 52 to the lower, or inner, heat sink 54 and the attachment of the upper or outer heat sink 66 thereto. The O-ring 74 surrounding the head of the bolt or screw 78 can be seen, which provides a hermetic seal. It can also be seen how the heat sinks 54 and 66 extend around the peripheral inner and outer edges of the LED array and the light engine 16 so as to substantially surround the light engine and the LED array 16 so as to effectively and uniformly draw heat away from the LEDs 52 and light engine. Typically, as illustrated, the LED array is directed downwardly, so as to illuminate an area below the lighting fixture 10, with the coupled heat sinks 54 and 66 extending outwardly and above the LED array and light engine. Thus, FIG. 22 represents a top view of the lighting fixture 10, or at least the light engine 16 and associated heat sinks 54 and 66, whereas FIG. 23 represents a lower view showing the LEDs 52, without any reflectors or lens cover, for purposes of illustration.

Figure 15:
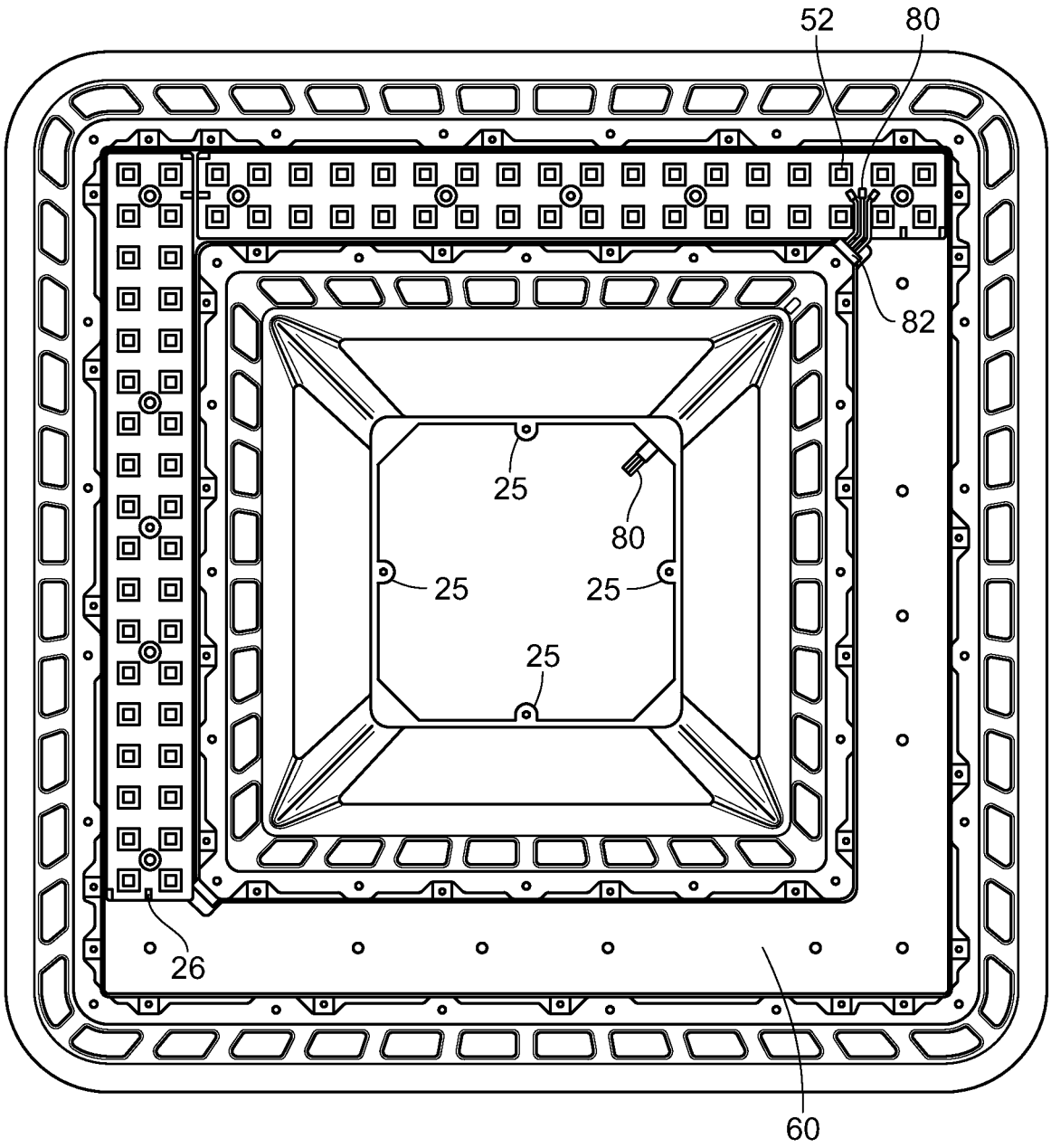
FIG. 15 is a bottom plan view of a lower light engine heat sink having a partial array of LEDs attached thereto.
Figure 16:
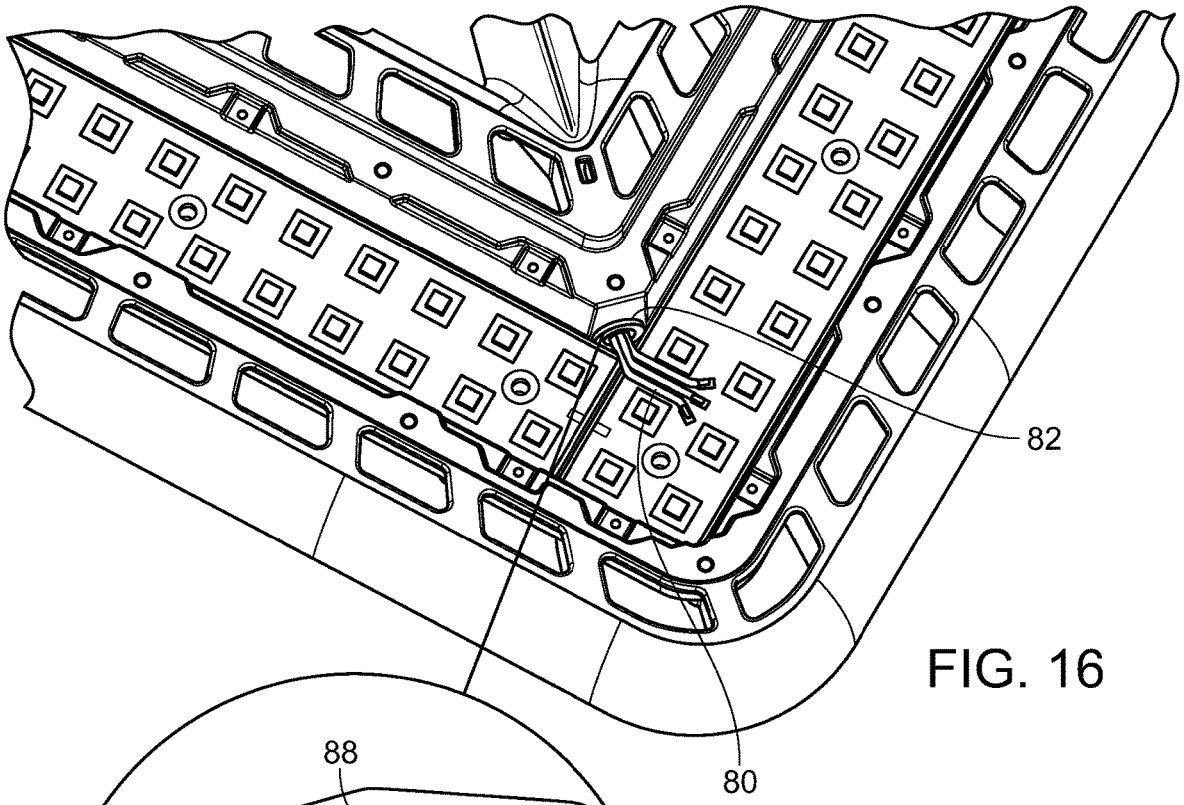
FIG. 16 is an enlarged perspective view, illustrating power wires extending to the LED array.
Figure 17:
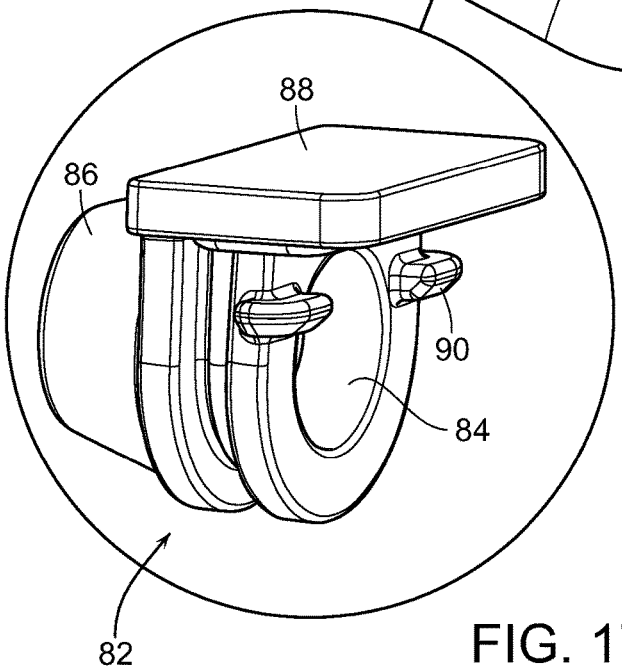
FIG. 17 is a perspective view of a wire cable seal, used in accordance with the present invention.
Figure 18:
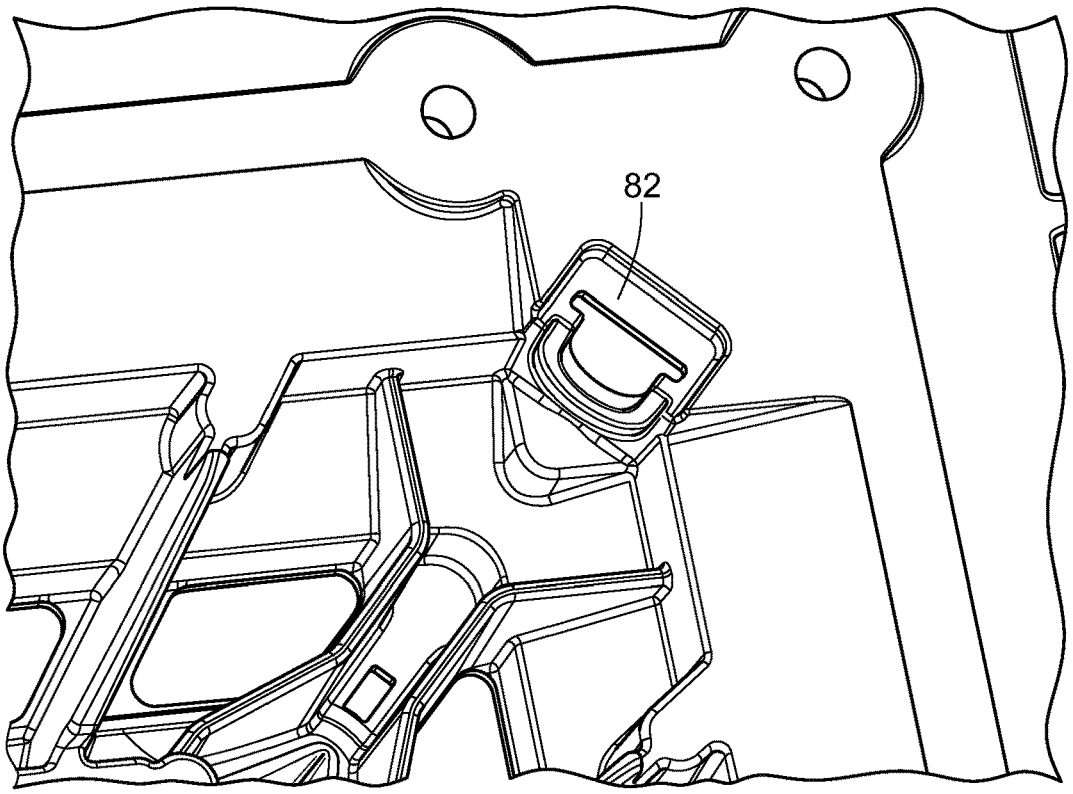
FIGS. 18 and 19 are partial perspective views illustrating the wire passthrough seal of FIG. 17, as used in the light engine.
Figure 19:
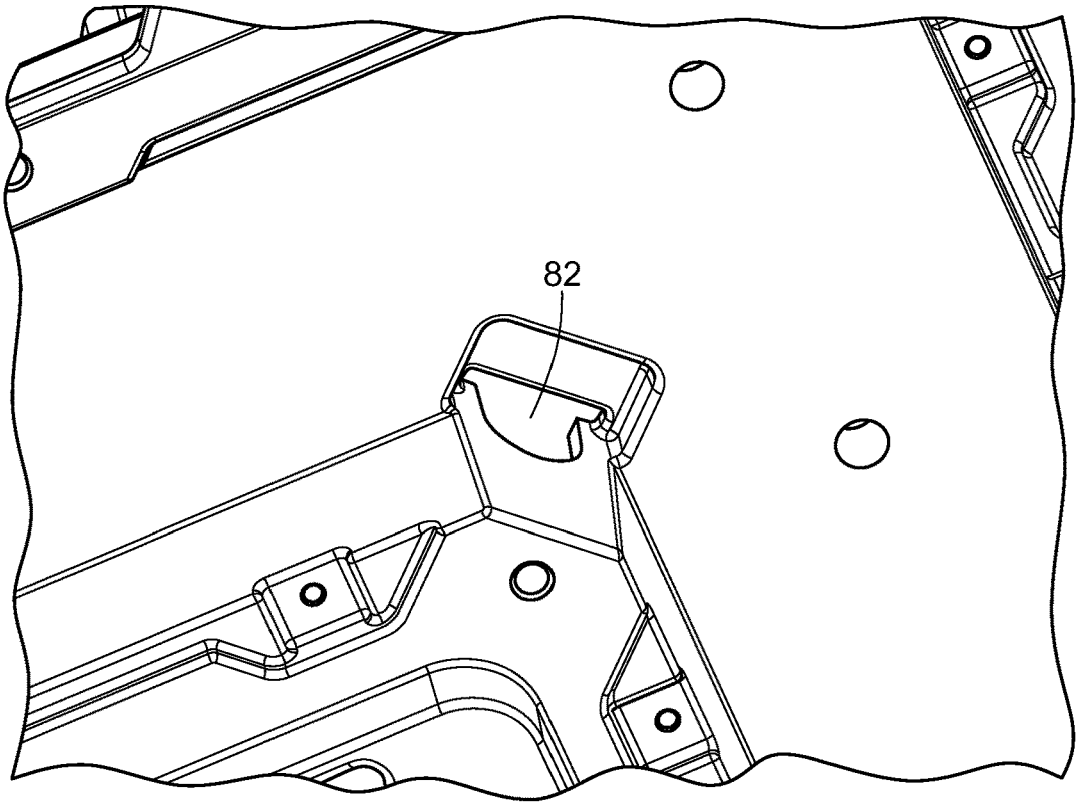
Figure 21:
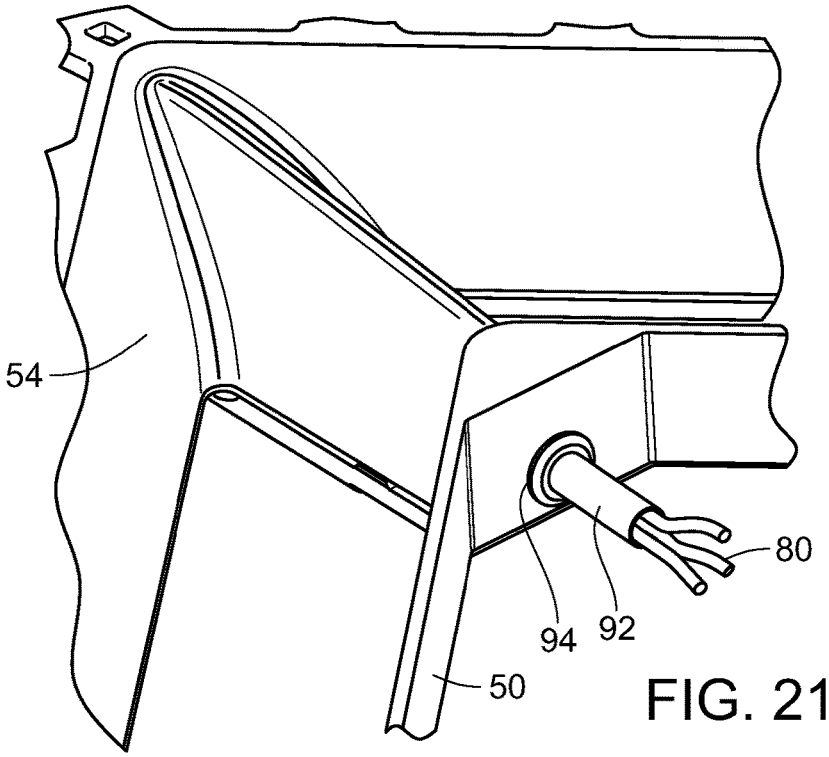
FIG. 21 is an enlarged partial perspective view illustrating a hermetic seal surrounding the power wires of FIG. 20.

With reference now to FIGS. 15-21, electrical leads or wires will extend from the driver 12 and to the PCB of the light engine 16 so as to supply power to the individual LEDs 52, as illustrated in FIG. 15. As illustrated in the enlarged view of FIGS. 16 and 17, a wire cable gasket 82, such as comprised of silicone or the like, is insertable into the passageway for the wires or cables, which may constitute positive and negative wiring, smart sensor wiring, etc. The cable gasket 82 defines a passageway 84 therethrough, one end 86 of the cable gasket 82 being of reduced cross-sectional outer and inner diameter so as to be frictionally inserted into the passageway and also constrict around the wiring so as to provide a seal therebetween, so as to prevent intrusion of water, dust, etc. to the LEDs, light engine and accompanying circuitry and components. An upper ledge 88 and spaced apart shoulders 90 enable snap-fit connection of the wire cable gasket 82 into the end of the passageway so as to form a connection therewith, as illustrated in FIGS. 18-20 and substantially surround and seal with an outer sheath 92 of the cable containing the wires 80, to form the hermetic seal therebetween. As illustrated in FIG. 21, other gaskets 94, such as an O-ring gasket or the like, may be used to seal any other points of entry or exit of the wiring 92 to provide a hermetic seal to prevent the environment from accessing the interior of the light engine and the sensitive components thereof.

Figure 10:
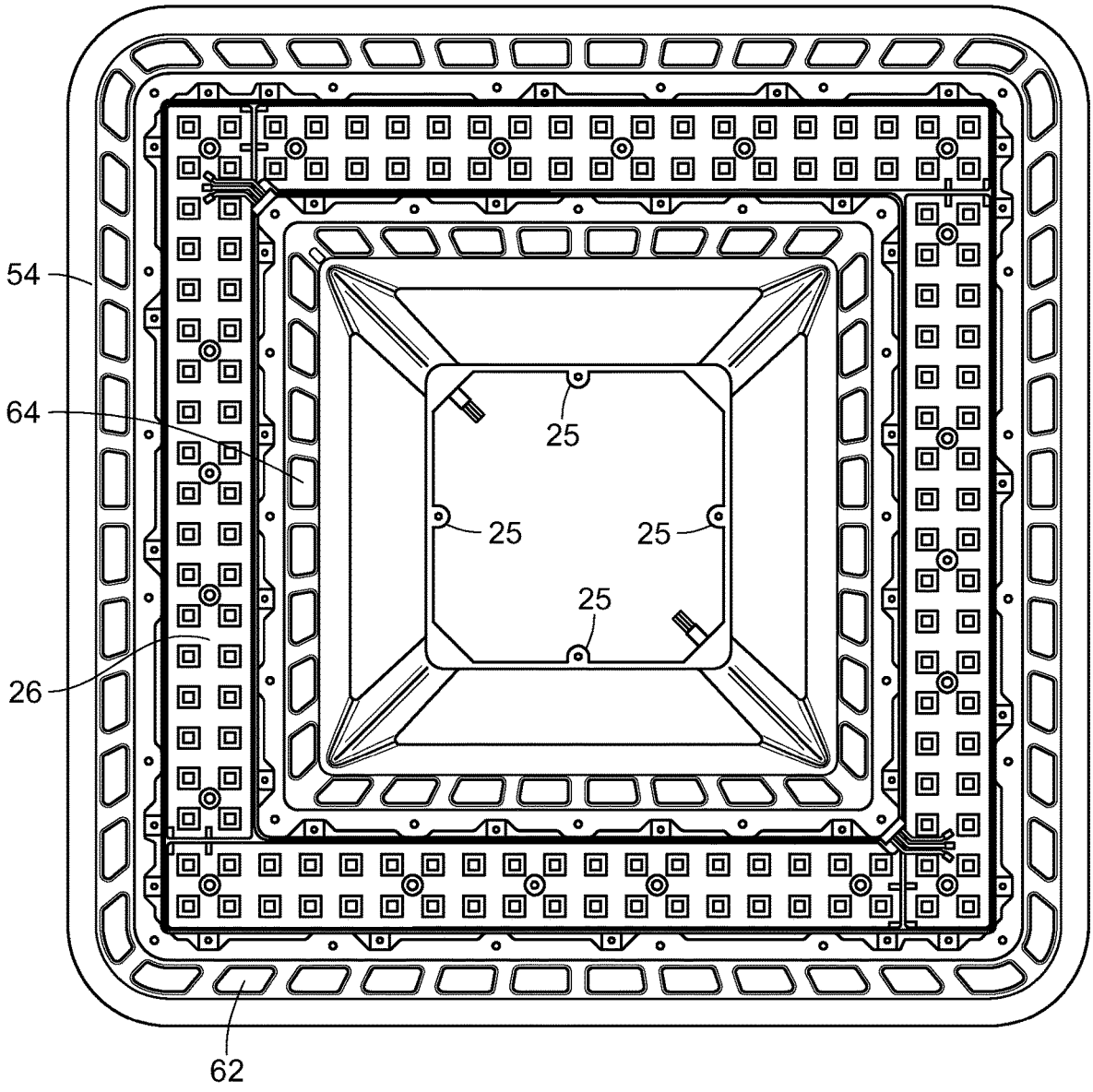
FIG. 10 is a bottom plan view of a lower light engine heat sink, with attached LEDs.

With reference again to FIG. 15, for purposes of illustration, only a portion of the full LED array 26 is shown, so as to show where the LED array will be attached to the lower heat sink base 60, so as to dispose the LED array between the rows of cooling fins 56 and 58, as described above. It will be understood, however, that typically the LED array extends substantially the length of the light engine and lower heat sink, as illustrated in FIG. 10.

Similarly, in FIG. 24, only a portion of the optic refractors 96 are shown, for purposes of illustration, surrounding the LEDs 52, although it will be understood, as illustrated in FIG. 8, that refractive optics 96 are preferably disposed substantially around the entirety of the array of LEDs, and typically substantially surrounding each LED 52 so as to disperse and direct the light generated from the LED 52 to the area below the lighting fixture 10 to be illuminated.

Figure 24:
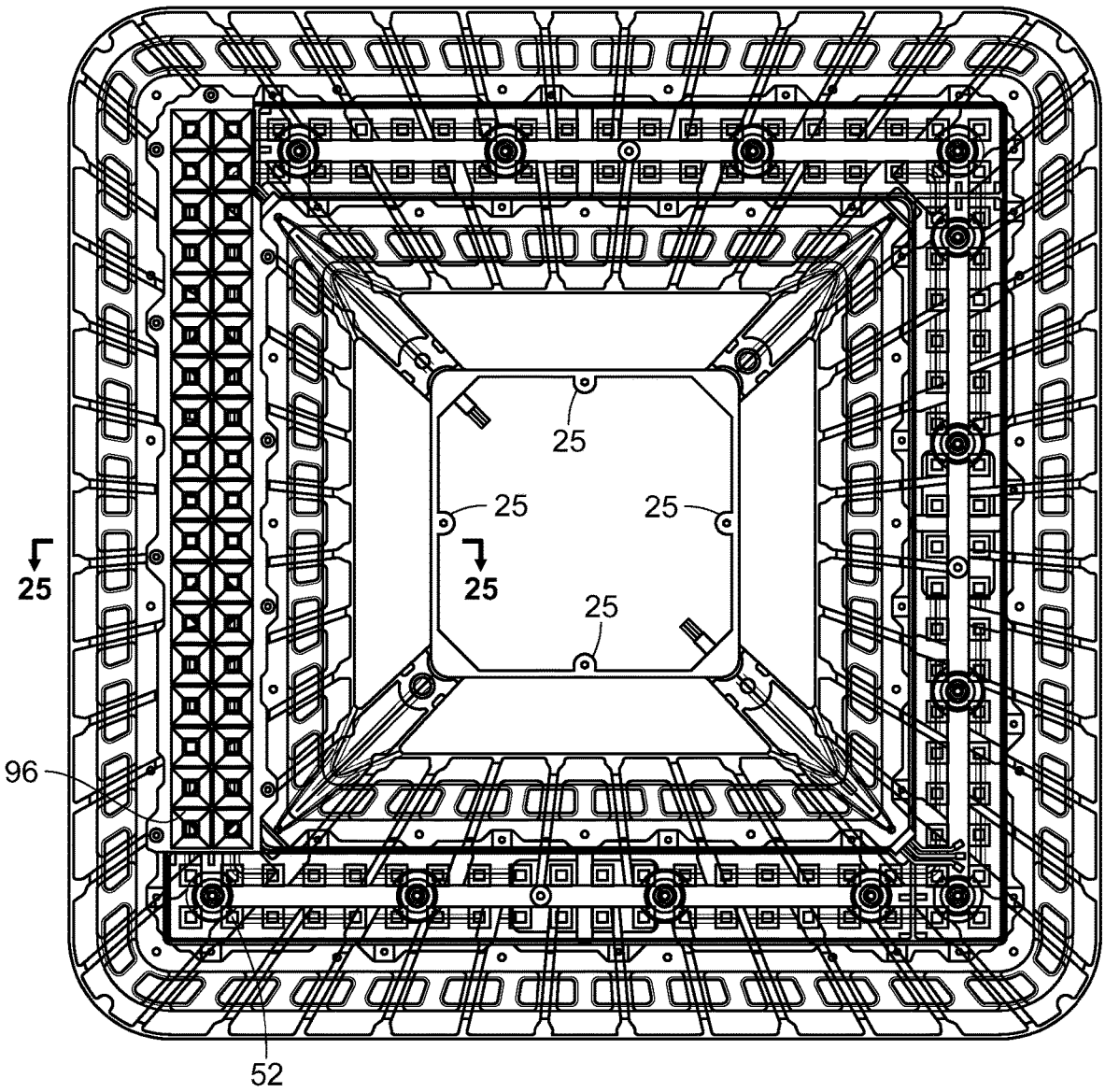
FIG. 24 is a bottom plan view of the light engine and heat sinks, with a portion of the LED array having optical reflectors.
Figure 25:
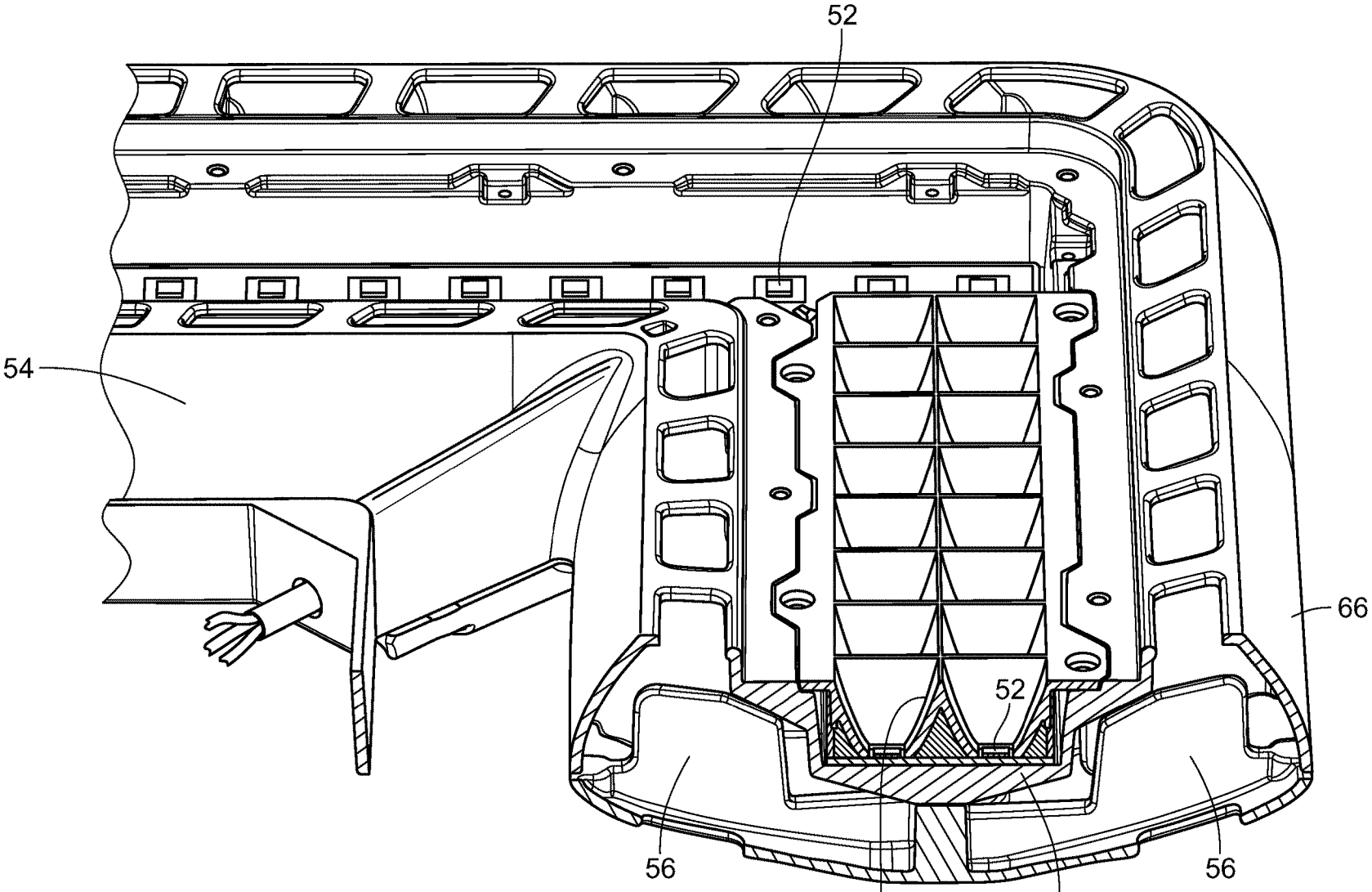
FIG. 25 is a partial perspective and sectioned view taken generally along line 25-25, illustrating placement of the optical reflectors.
Figure 26:
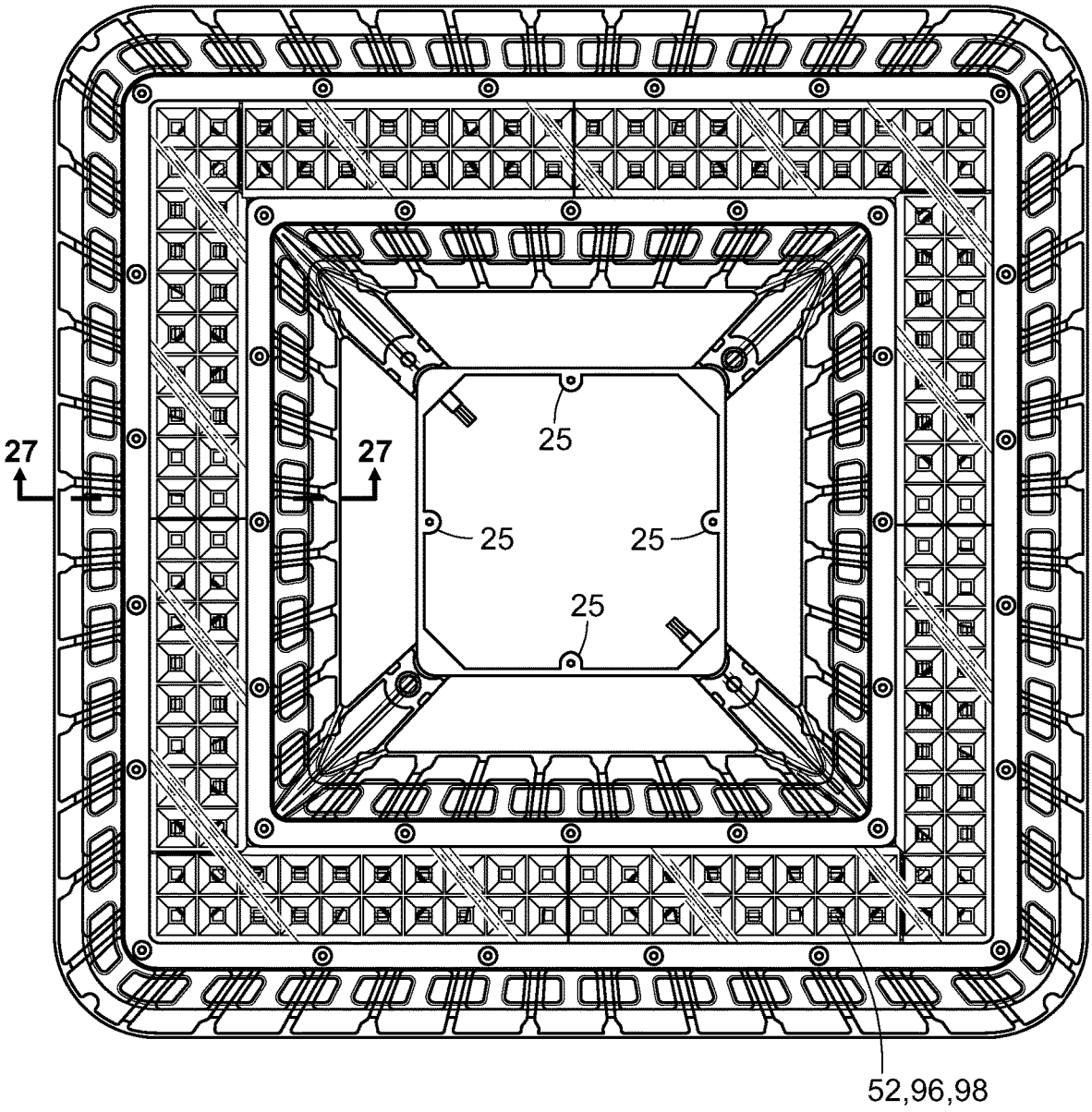
FIG. 26 is a bottom plan view of the light engine and heat sinks.
Figure 27:
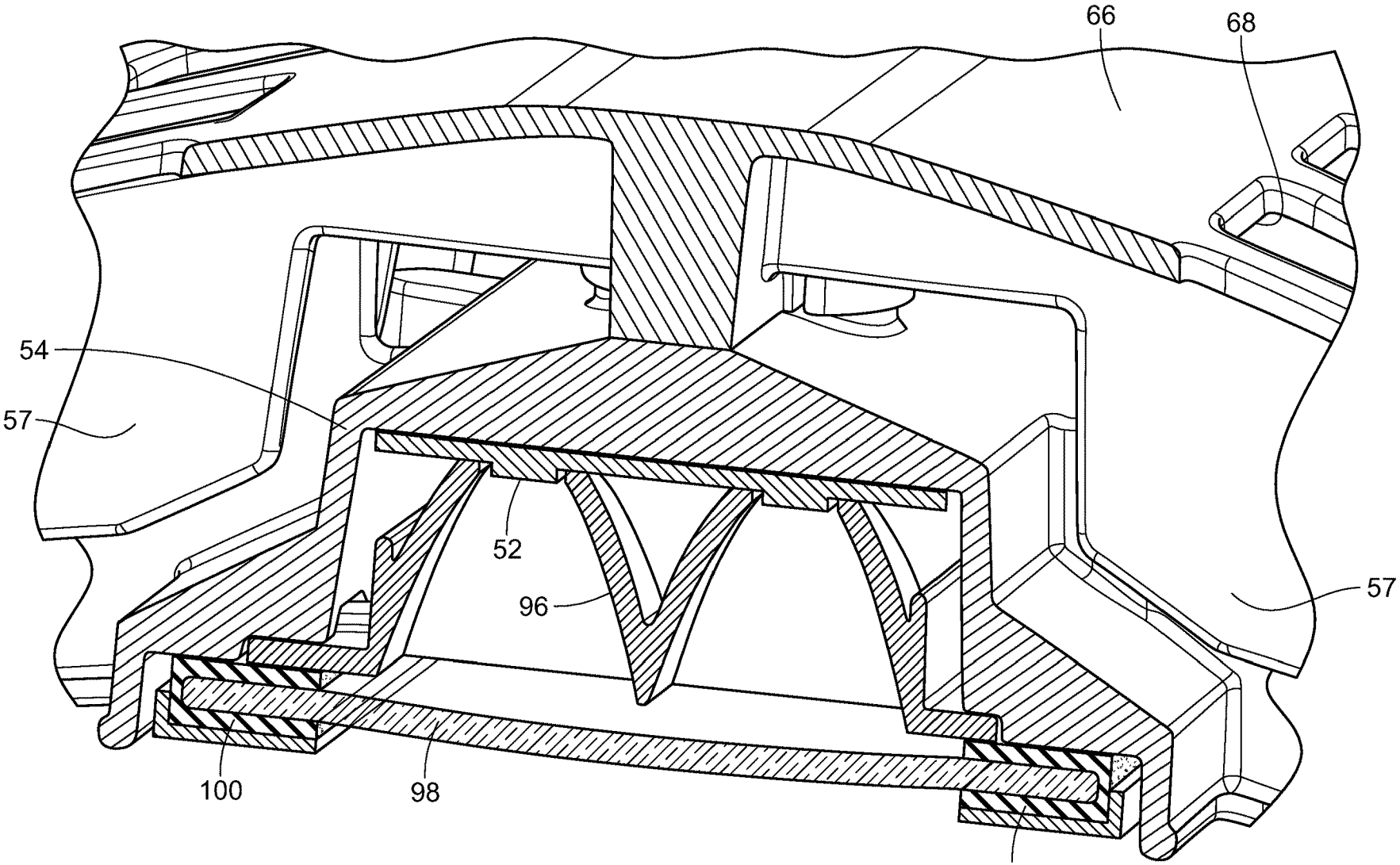
FIG. 27 is a cross-sectional view taken generally along line 27-27 of FIG. 26, illustrating hermetic sealing of a cover lens and optical reflectors of the light engine.
Figure 28:
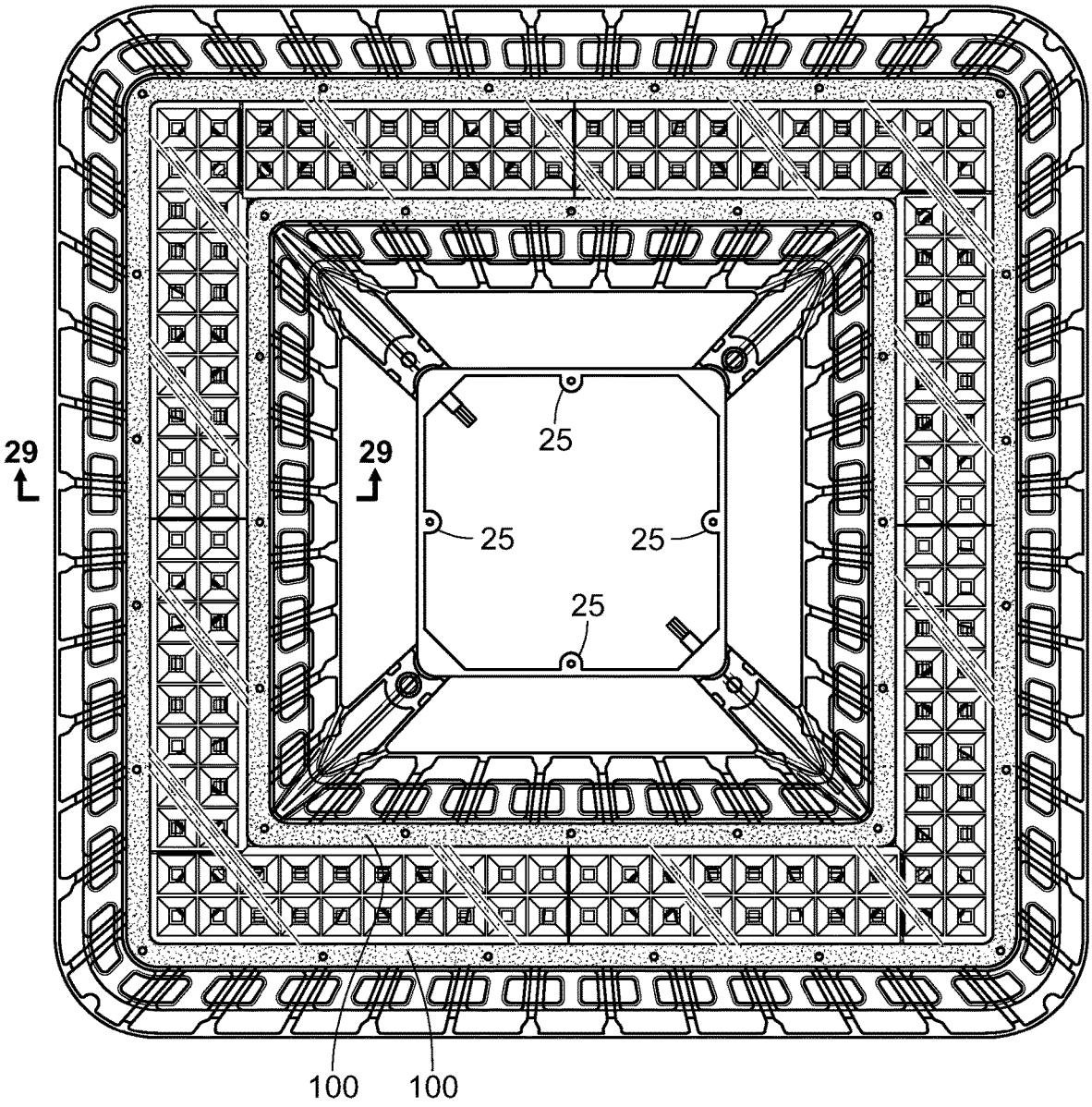
FIG. 28 is a bottom plan view of the light engine and heat sinks.
Figure 29:
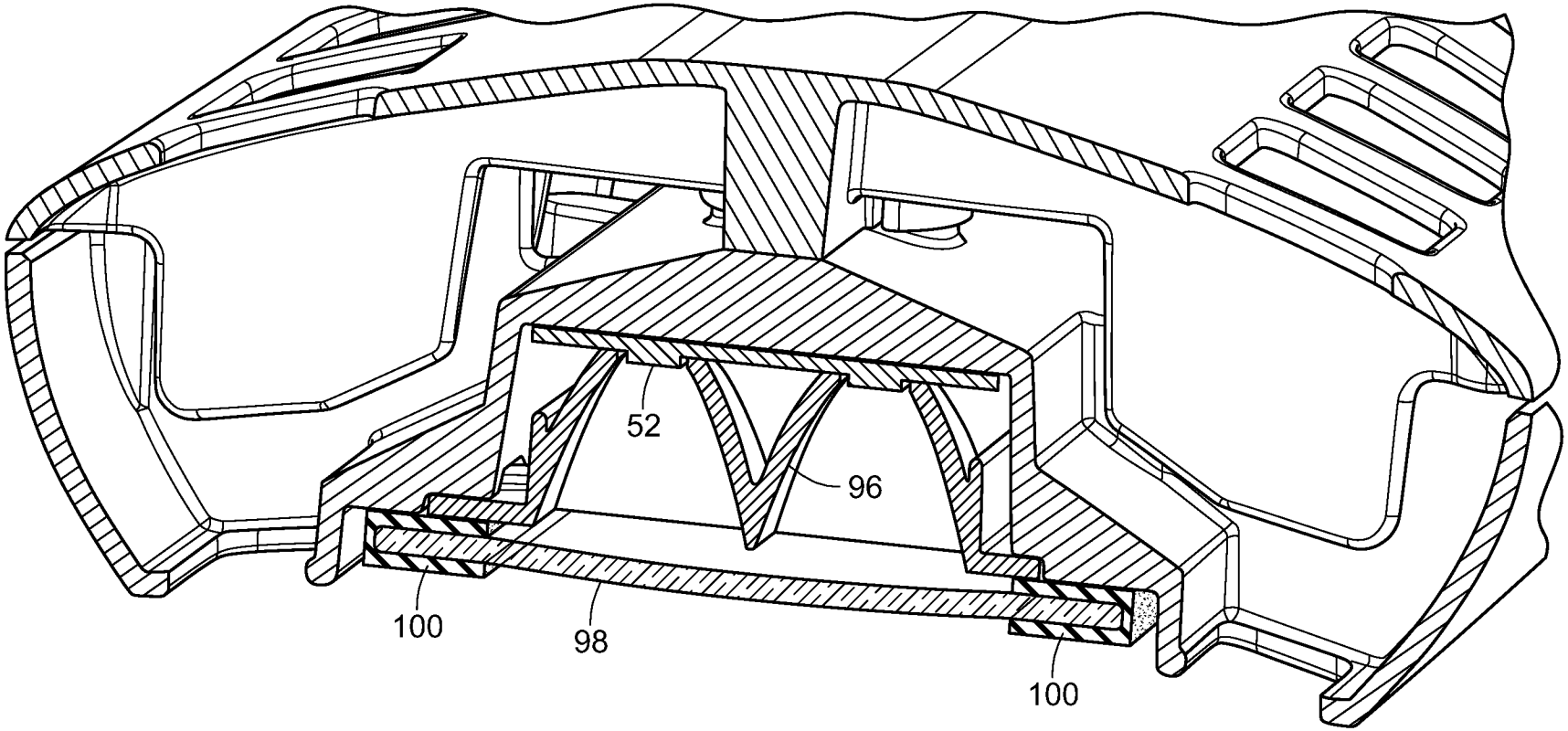
FIG. 29 is a cross-sectional view similar to FIG. 27.

FIG. 25 is a partially sectioned perspective view taken generally along line 25-25 of FIG. 24, illustrating a typical arrangement of the optical reflectors 96 with respect to the individual LEDs 52 of the light engine 16. Typically, as illustrated, a single LED 52 will be substantially surrounded by optical reflectors 96 having generally curved or multi-faceted surfaces formed of a material or coated so as to form a highly reflective surface to reflect and disperse the light, as desired. This is also seen in FIGS. 26-29. In these illustrations, however, while the optical reflectors 96 substantially surround each LED of the LED array, so as to properly disperse the light, a cover lens 98 is also disposed over this arrangement so as to protect the LEDs from water, dust, etc.

Two U-shaped lens gaskets 100 wrap around the outer and inner edge of the lens 98, to further provide a hermetic seal. These gaskets 100 may also be comprised of silicone or the like. The lens 98 provides a protective barrier, as mentioned above, and provides a barrier and surface for protecting the LEDs 52, and interior of the light engine as well as an easily cleanable surface when dust and other material collects thereon.

Figure 30:
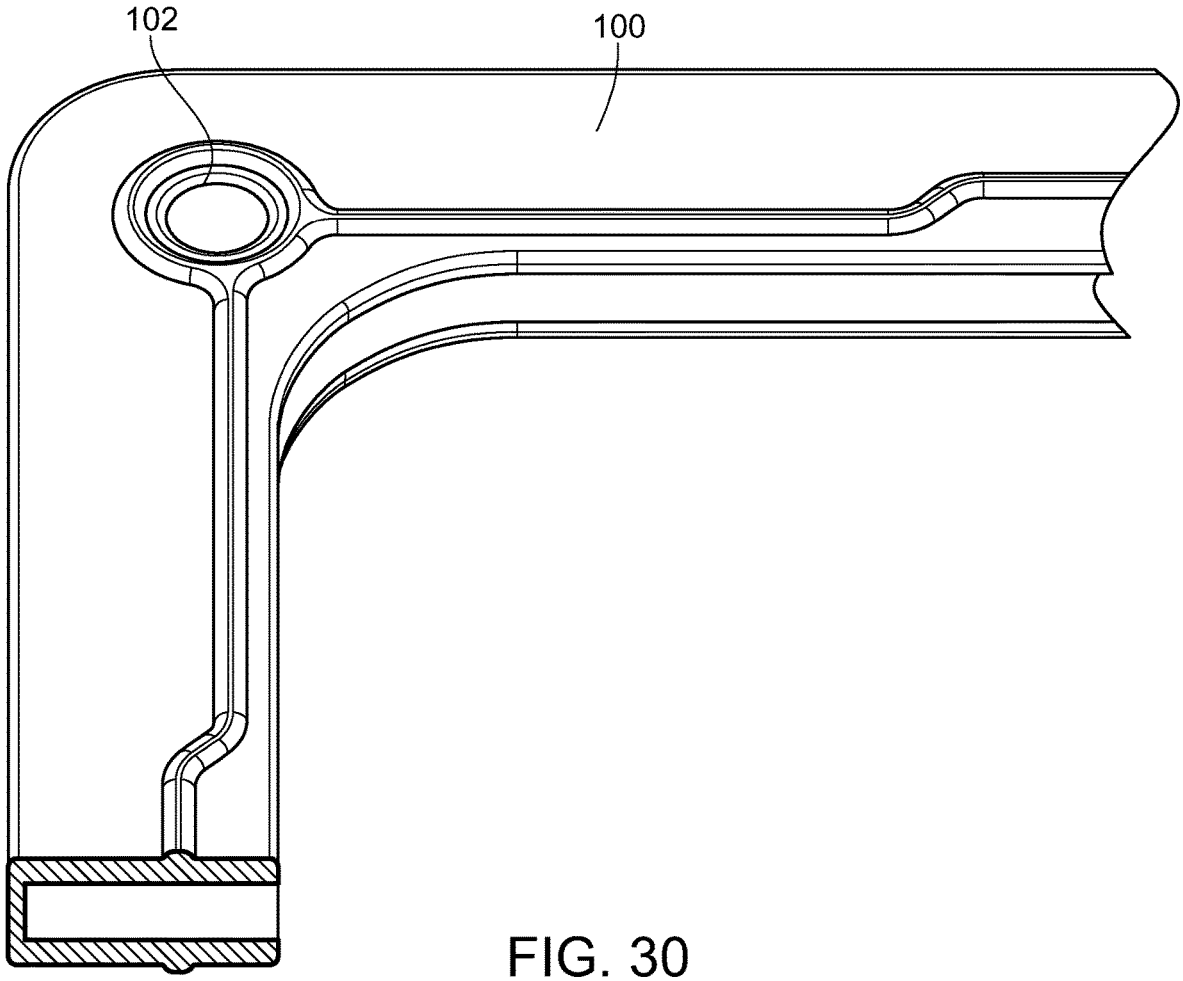
FIG. 30 is a partially sectioned perspective view of a U-shaped lens gasket wrapped around outer and inner edges of the cover lens, in accordance with the present invention.
Figure 31:
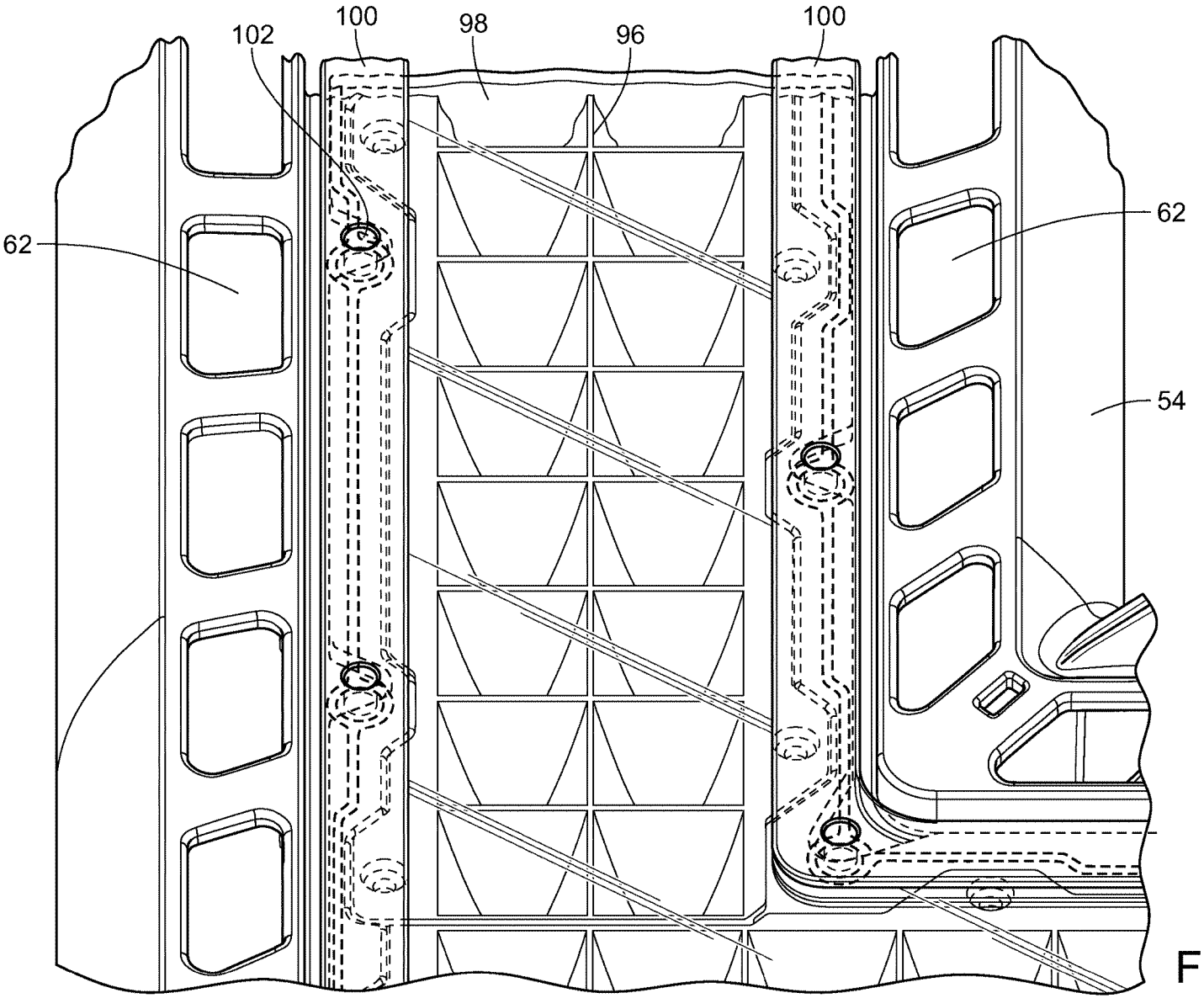
FIG. 31 is a partial bottom perspective view illustrating a lens trim attached onto the body of the heat sinks, in accordance with the present invention.

With reference now to FIGS. 30 and 31, the inner and outer U-shaped lens gaskets 100 may have a semi-circular protrusion 102 on the bottom that goes around the reflector screw tabs and lens screw holes to prevent any external water, vapor or dust from penetrating the light engine. Preferably, the screws are marine-rated stainless steel for corrosion protection. There may also be included an L-shaped stainless-steel lens trim, which tightens the lens via screws onto the body, squeezing the overall silicone lens gasket 100 to make a hermetic seal. The lens trim may comprise inner and outer pieces.

Figure 32:
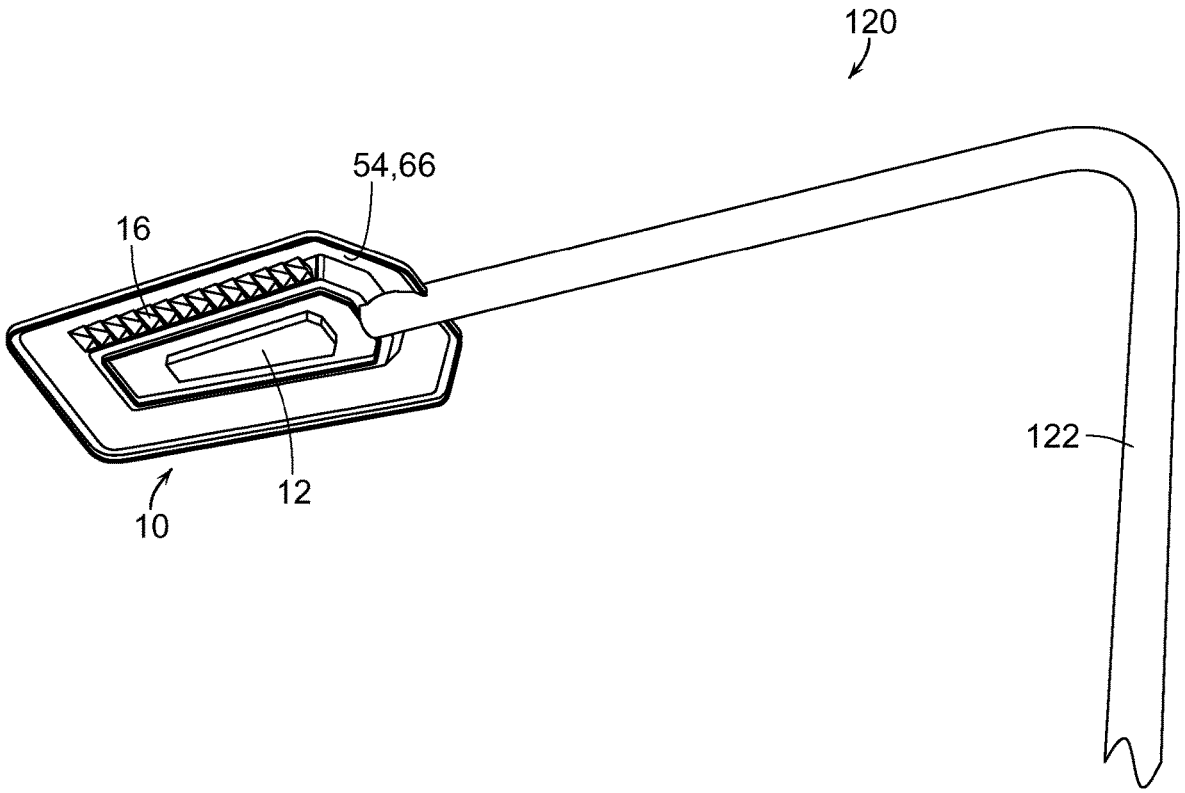
FIG. 32 is a partial perspective lower view of an exemplary streetlight embodying the present invention.
Figure 33:
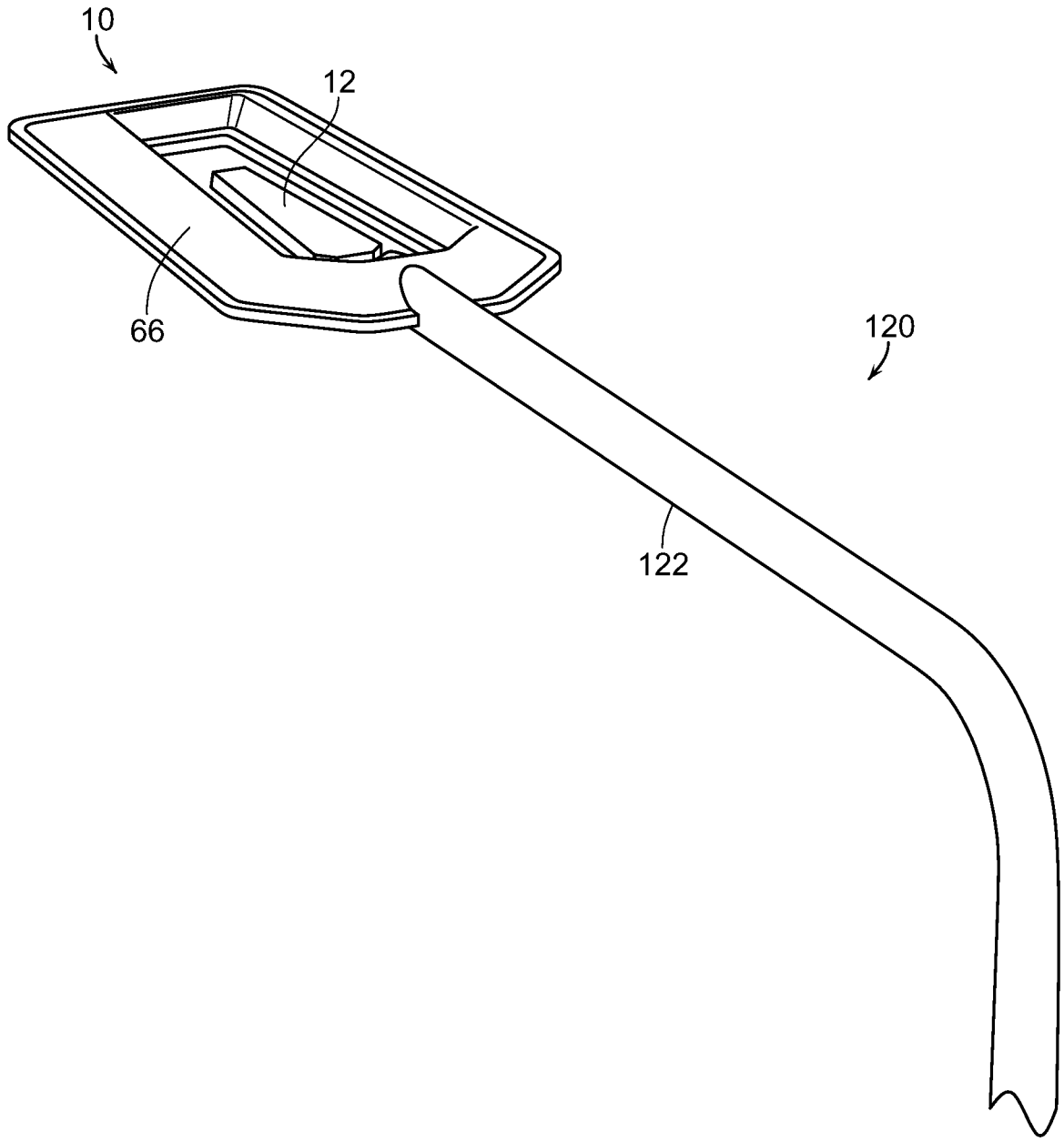
FIG. 33 is a top perspective view of the streetlight of FIG. 32.

With reference now to FIGS. 32 and 33, illustrated is a streetlamp 120 as an example of how the lighting fixture 10 or a variation thereof of the present invention can be used. The lighting fixture 10 is attached to the end of a pole 122. Preferably, an upper cover, which may comprise the outer or upper heat sink 66 is faceted and angled so as to discourage birds and the like from landing thereon. The driver 12 and junction box and the like are shown centrally located surrounding the ring-shaped light engine 16 and accompanying heat sink 54 and/or 66. Such a streetlight would have all of the advantages described above with respect to the lighting fixture of the present invention.

Although several embodiments have been described in detail for purposes of illustration, various modifications may be made without departing from the scope and spirit of the invention. Accordingly, the invention is not to be limited, except as by the appended claims.

What is claimed is:

1. A heat dissipating lighting fixture, comprising:

a light engine having a plurality of light emitting diodes formed in at least one elongated row extending substantially a length of the light engine, the light emitting diodes forming an array having an outer perimeter edge and an inner perimeter edge;

at least one light engine heat sink conductively coupled to the light engine and disposed adjacent to the outer perimeter edge and the inner perimeter edge of the light emitting diode array; and a driver assembly coupled to the light engine in spaced relation thereto, the driver assembly comprising a driver for supplying power to the light engine and a driver heat sink conductively coupled to the driver;

wherein the at least one light engine heat sink comprises spaced apart cooling fins and vent apertures; and wherein the at least one light engine heat sink comprises spaced apart generally parallel rows of cooling fins, the light emitting diode array being disposed between the rows of cooling fins.

2. The lighting fixture of claim 1, wherein the driver heat sink is disposed relative to the at least one light engine heat sink so as to prevent conductive heat transfer therebetween.

3. The lighting fixture of claim 2, wherein the light engine is generally ring-shaped.

4. The lighting fixture of claim 1, wherein the light emitting diode array comprises a plurality of generally parallel rows of light emitting diodes.

5. The lighting fixture of claim 1, wherein the driver assembly is substantially surrounded by the light engine, in spaced relation thereto.

6. The lighting fixture of claim 1, wherein the driver assembly is substantially exposed to ambient air.

7. The lighting fixture of claim 1, wherein the at least one light engine heat sink comprises an upper light engine heat sink and a lower light engine heat sink disposed relative to one another such that air vents of the upper light engine heat sink are each aligned with at least one cooling fin of the lower light engine heat sink.

8. The lighting fixture of claim 1, wherein the fins and vent apertures of the upper and lower light engine heat sinks are disposed over the outer perimeter edge and inner perimeter edge of the light emitting diode array.

9. The lighting fixture of claim 1, wherein the upper and lower light engine heat sinks are attached to one another so as to extend over and at least partially surround the light emitting diode array.

10. The lighting fixture of claim 9, wherein the light engine, driver assembly and junction box are hermetically sealed.

11. The lighting fixture of claim 1, including a junction box formed adjacent to the driver.

12. The lighting fixture of claim 11, wherein a cover of the junction box is dome-shaped.

13. A heat dissipating lighting fixture, comprising:

a light engine having a plurality of light emitting diodes formed in at least one elongated row extending substantially a length of the light engine, the light emitting diodes forming an array having an outer perimeter edge and an inner perimeter edge;

an upper light engine heat sink conductively coupled to the light engine and having spaced apart cooling fins and vent apertures disposed adjacent to the outer perimeter edge and the inner perimeter edge of the light emitting diode array;

a lower light engine heat sink conductively coupled to the light engine and having spaced apart cooling fins and vent apertures disposed adjacent to the outer perimeter edge and the inner perimeter edge of the light emitting diode array;

a driver assembly coupled to the light engine in spaced relation thereto, the driver assembly comprising a driver for supplying power to the light engine and a driver heat sink conductively coupled to the driver and disposed relative to the upper and lower light engine heat sinks so as to prevent conductive heat transfer between the driver heat sink and the upper and lower light engine heat sinks;

wherein the cooling fins of the lower light engine heat sink comprises spaced apart generally parallel rows of cooling fins, the light emitting diode array being disposed between the rows of cooling fins; and wherein the upper and lower light engine heat sinks are disposed relative to one another such that air vents of the upper light engine heat sink are each aligned with at least one cooling fin of the lower light engine heat sink.

14. The lighting fixture of claim 13, wherein the light emitting diode array comprises a plurality of generally parallel rows of light emitting diodes.

15. The lighting fixture of claim 13, wherein the driver assembly is substantially surrounding by the light engine, in spaced relation thereto.

16. The lighting fixture of claim 15, wherein the light engine is generally ring-shaped.

17. The lighting fixture of claim 13, wherein the driver assembly is substantially exposed to ambient air.

18. The lighting fixture of claim 13, wherein the fins and vent apertures of the upper and lower light engine heat sinks are disposed over the outer perimeter edge and inner perimeter edge of the light emitting diode array.

19. The lighting fixture of claim 13, wherein the upper and lower light engine heat sinks are attached to one another so as to extend over and at least partially surround the light emitting diode array.

20. The lighting fixture of claim 13, including a junction box formed adjacent to the driver.

21. The lighting fixture of claim 20, wherein a cover of the junction box is dome-shaped.

22. The lighting fixture of claim 20, wherein the light engine, driver assembly and junction box are hermetically sealed.

23. A heat dissipating lighting fixture, comprising:

a generally ring-shaped light engine having a plurality of light emitting diodes formed in at least one elongated row extending substantially a length of the light engine, the light emitting diodes forming an array having an outer perimeter edge and an inner perimeter edge;

at least one light engine heat sink conductively coupled to the light engine and disposed adjacent to the outer perimeter edge and the inner perimeter edge of the light emitting diode array; and a driver assembly substantially surrounded by the light engine, in spaced relation thereto, the driver assembly comprising a driver for supplying power to the light engine and a driver heat sink conductively coupled to the driver.

* * * * *